US012654828B2

(12) United States Patent
Thompson

(10) Patent No.: US 12,654,828 B2
(45) Date of Patent: Jun. 16, 2026

(54) WINGSAIL

(71) Applicant: GT Green Technologies Limited, Albourne (GB)

(72) Inventor: George Thompson, Albourne (GB)

(73) Assignee: GT Green Technologies Limited, Albourne (GB)

( * ) Notice: Subject to any disclaimer, the term of this patent is extended or adjusted under 35 U.S.C. 154(b) by 0 days.

(21) Appl. No.: 18/725,010

(22) PCT Filed: Dec. 23, 2022

(86) PCT No.: PCT/EP2022/087721
§ 371 (c)(1),
(2) Date: Jun. 27, 2024

(87) PCT Pub. No.: WO2023/126346
PCT Pub. Date: Jul. 6, 2023

(65) Prior Publication Data

US 2025/0066004 A1 Feb. 27, 2025

(30) Foreign Application Priority Data

Dec. 28, 2021 (GB) ..... 2119051
Jun. 22, 2022 (GB) ..... 2209179

(51) Int. Cl.
*B63H 9/061* (2020.01)
*F04D 25/16* (2006.01)

(52) U.S. Cl.
CPC ..... *B63H 9/0621* (2020.02); *F04D 25/166* (2013.01)

(58) Field of Classification Search
CPC .... B63H 9/0621; B63H 9/0635; B63H 9/061; F04D 25/166; B63B 2015/0058; B63B 2035/009; Y02T 50/10; Y02T 70/5236
See application file for complete search history.

(56) References Cited

U.S. PATENT DOCUMENTS 4,467,741 A * 8/1984 Walker ..... B63H 9/061 114/102.22
4,610,213 A * 9/1986 Walker ..... G01L 19/0007 114/102.16

(Continued)

FOREIGN PATENT DOCUMENTS

CN 104724272 A 6/2015
CN 104724272 B 3/2017

(Continued)

OTHER PUBLICATIONS

Ogami JPS6325195AMT (Year: 1988).*

(Continued)

*Primary Examiner* — Nathaniel E Wiehe
*Assistant Examiner* — Wayne A Lambert
(74) *Attorney, Agent, or Firm* — DUANE MORRIS LLP; Gregory M. Lefkowitz; Daniel J. Tarr

(57) ABSTRACT

A wingsail comprising: a first aerofoil having a leading edge at a front of the wingsail and a trailing edge behind the front edge; and a second aerofoil having a leading edge and a trailing edge, the leading edge of the second aerofoil being closer than the trailing edge of the second aerofoil to a point of maximum cross-sectional width of the second aerofoil; wherein the wingsail is configured such that the leading edge of the second aerofoil can be positioned behind the trailing edge of the first aerofoil; wherein the first aerofoil comprises: an air inlet; an air outlet; a channel inside the first aerofoil connecting the air inlet and the air outlet; wherein air flow from the air inlet is directed by the channel to the air outlet.

21 Claims, 28 Drawing Sheets

(56) References Cited

U.S. PATENT DOCUMENTS

| | | | | | |
|---|---|---|---|---|---|
| 4,630,997 | A * | 12/1986 | Cousteau | B64C 21/06 | 416/4 |
| 4,669,409 | A * | 6/1987 | Asker | B63H 9/061 | 114/102.32 |
| 4,856,449 | A * | 8/1989 | Walker | B63H 9/061 | 114/102.22 |
| 4,982,679 | A * | 1/1991 | Walker | B63H 9/061 | 114/102.16 |
| 2014/0144362 | A1* | 5/2014 | Atkinson | B63H 9/06 | 114/102.15 |
| 2014/0182500 | A1* | 7/2014 | White, I | B63B 15/0083 | 114/39.31 |
| 2018/0162502 | A1* | 6/2018 | McClure | B63G 8/04 | |
| 2019/0256182 | A1* | 8/2019 | Van Peteghem | B63H 9/0635 | |
| 2020/0262531 | A1 | 8/2020 | Kuhlmann | | |
| 2023/0249794 | A1* | 8/2023 | Podhola | B63H 21/17 | 114/39.11 |

FOREIGN PATENT DOCUMENTS

| | | | | |
|---|---|---|---|---|
| DE | 4333635 | A1 * | 4/1994 | B63H 9/061 |
| DE | 19818323 | A1 * | 11/1999 | F03D 9/32 |
| EP | 0061291 | A2 | 9/1982 | |
| GB | 233703 | A | 12/1925 | |
| JP | S6325195 | A | 2/1988 | |
| WO | 2015155518 | | 10/2015 | |
| WO | 2020115717 | | 6/2020 | |

OTHER PUBLICATIONS

Wang et al. CN104724272 _ English Machine Transition _ Espacenet (Year: 2015).*

Thompson, George; International Search Report and Written Opinion for PCT/EP2022/087721, filed Dec. 23, 2022, mailed Mar. 20, 2023, 14 pgs.

Thompson, George; Search Report for United Kingdom patent application No. GB2209179.7, mailed Jul. 7, 2022, 5 pgs.

* cited by examiner

WINGSAIL

FIELD OF THE INVENTION

The present disclosure relates to a wingsail, and a method for operating a wingsail. More particularly, the present disclosure relates to a wingsail for a watercraft. The watercraft may comprise a powered watercraft in some examples.

BACKGROUND

Known wingsails include wingsails comprised of a single aerofoil. Wingsails comprising multiple aerofoils are also known. Wingsails can be used for marine vessels to reduce energy requirements during operation, for example during transport of goods. This reduction in energy requirements can reduce carbon emissions.

SUMMARY OF INVENTION

In a first aspect, there is provided a wingsail comprising: a first aerofoil having a leading edge at a front of the wingsail and a trailing edge behind the leading edge; and a second aerofoil having a leading edge and a trailing edge, the leading edge of the second aerofoil being closer than the trailing edge of the second aerofoil to a point of maximum cross-sectional width of the second aerofoil; wherein the wingsail is configured such that the leading edge of the second aerofoil can be positioned behind the trailing edge of the first aerofoil; wherein the first aerofoil comprises: an air inlet; an air outlet; a channel inside the first aerofoil connecting the air inlet and the air outlet; wherein air flow from the air inlet is directed by the channel to the air outlet.

According to some examples, the second aerofoil has a first portion comprising the leading edge of the second aerofoil, wherein the first portion is rounded.

According to some examples, the second aerofoil is symmetrical along a chord line of the second aerofoil.

According to some examples, the chord line comprises a longitudinal axis from the leading edge to the trailing edge.

According to some examples, the air flow from the air outlet is directed out of the air outlet towards the leading edge of the second aerofoil.

According to some examples, the air outlet is positioned at the trailing edge of the first aerofoil.

According to some examples, the air inlet comprises a port air inlet positioned on a port side of the first aerofoil and a starboard air inlet positioned on a starboard side of the first aerofoil; wherein when the wingsail is being used on a starboard tack the first aerofoil is configured so that air flow is directed through the port air inlet and is not directed through the starboard air inlet, and wherein when the wingsail is being used on a port tack the first aerofoil is configured so that air flow is directed through the starboard air inlet and is not directed through the port air inlet.

According to some examples, the wingsail is configured to: rotate the second aerofoil to starboard relative to the first aerofoil when the wingsail is used on a starboard tack such that the air outlet of the first aerofoil directs air flow towards the port leading edge of the second aerofoil; and rotate the second aerofoil to port relative to the first aerofoil when the wingsail is being used on a port tack such that the air outlet of the first aerofoil directs air flow towards the starboard leading edge of the second aerofoil.

According to some examples, the wingsail is configured to: when the wingsail is being used on a starboard tack, draw air in the port air inlet and not draw air in the starboard air inlet, and when the wingsail is being used on a port tack, draw air in the starboard air inlet and not draw air in the port air inlet.

According to some examples, the wingsail comprises: a pressure differential generator in the first aerofoil, the pressure differential generator configured to create negative internal pressure in the first aerofoil, wherein the negative internal pressure draws air into the main body of the device through the air inlet.

According to some examples, the pressure differential generator comprises: one or more fans driven by a motor; or a series of fans connected by one fan shaft and driven by a motor.

According to some examples, the channel comprises the pressure differential generator and an air vent.

According to some examples, the channel is configured to direct flow from the inlet at a first position along a span of the first aerofoil and directs this flow to the air outlet, wherein the span of the first aerofoil is a distance from a base of the wingsail to a tip of the first aerofoil.

According to some examples, the wingsail comprises: one or more wingsail modules, wherein the wingsail modules are configured to be vertically stacked on each other, wherein each vertical module comprises an air inlet, an air outlet, a pressure differential generator and an air vent According to some examples, the channel comprises internal flow straighteners.

According to some examples, the second aerofoil rotates to a maximum rotation position relative to the first aerofoil to minimise a total span of the wingsail, and wherein the wingsail folds at a base of the wingsail to form a stowed configuration.

According to some examples, the base of the wingsail is formed from at least one welded or seamless metal pipe.

According to some examples, the wingsail comprises a protective casing for covering the first aerofoil and the second aerofoil in the stowed configuration, wherein the protective casing allows the wingsail to be raised and/or lowered and allows the wingsail to be covered when the wingsail is lowered and in the stowed configuration by performing at least one of the following: folding; rotating; rolling along a track.

According to some examples, the wingsail comprises control software for opening and closing the inlet or directing the flow from one air inlet to the next; a mechanical control system for opening and closing the inlet.

According to some examples, the wingsail comprises a mechanical system which is triggered to open or close the inlet based on the movement of the second aerofoil.

According to some examples, wherein the second aerofoil comprises at least one air inlet.

According to some examples, the second aerofoil comprises at least one air outlet.

According to some examples, the first aerofoil comprises a plurality of air inlets.

According to some examples, the first aerofoil comprises a plurality of air outlets.

According to some examples, the first aerofoil comprises at least one air outlet positioned between a portion comprising the leading edge of the first aerofoil and a portion comprising the trailing edge of the first aerofoil.

According to some examples, the second aerofoil comprises at least one air outlet positioned between a portion comprising the leading edge of the second aerofoil and a portion comprising the trailing edge of the second aerofoil.

According to some examples, the wingsail is configured to form a stowed configuration by: rotating the second aerofoil relative to the first aerofoil such that the chord lines of each aerofoil are substantially perpendicular to one another; and then rotating both aerofoils from the base of the wingsail to a horizontal position to form a stowed configuration.

According to some examples, the wingsail comprises a base structure, the base structure comprising: three or more pillars supporting a platform, each of the three or more pillars having a height between two metres and four metres, wherein the first aerofoil and second aerofoil are positioned above the platform.

According to some examples, the wingsail comprises a linear actuator for raising and lowering the wingsail, the linear actuator being positioned above the platform.

According to some examples, the air inlet of the first aerofoil element is located within a front quarter of a chord length of the first aerofoil element.

In a second aspect there is provided a double element wingsail comprising a first aerofoil element and a second aerofoil element, wherein the second aerofoil element is configured to rotate relative to the first aerofoil element about a first rotation axis and a second rotation axis.

According to some examples, the second aerofoil element can be rotated relative to the first aerofoil element by an angle greater than 180 degrees.

According to some examples, the first rotation axis of the second element is located within the first aerofoil element and the second rotation axis is located within the second aerofoil element.

According to some examples, the second aerofoil element is configured to rotate relative to the first aerofoil element so as to form a cambered shape with a slot between the first aerofoil element and the second aerofoil element, and also configured to fold to a tightly packed configuration wherein the direction of the second element is reversed to minimise the total chord length and section thickness of the wingsail.

According to some examples, the second aerofoil element is connected to the first aerofoil element via one or more independently rotating linking members.

According to some examples, the independently rotating linking member comprises two or more bars.

According to some examples, the bars of the independently rotating linking member are connected by a torsional spar so that each bar cannot rotate independently of any other bar.

According to some examples, one or more linking members is configured to rotate relative to a first element via two or more rotational bearings, preferably wherein the two or more rotational bearings comprise self-aligning bearings, and preferably wherein the self-aligning bearings are connected to the first element structure.

According to some examples, a second element is rotatable relative to one or more linking members about two or more bearings, preferably self-aligning bearings, which are preferably connected to the second element structure.

According to some examples, one or more linking members are rotational relative to the first element and a second aerofoil element is rotational in relation to both the first aerofoil element and one or more linking members.

According to some examples, one or more linking members is rotational relative to a first element and is controlled by a linear actuator, preferably a hydraulic ram with a rotational connection between a linking member and a first aerofoil element.

According to some examples, the second aerofoil element is rotationally connected to one or more linking members which are also connected to the first aerofoil element, and where the rotation of a second aerofoil element in relation to any linking member is controlled by a linear actuator which is rotationally connected to the second aerofoil element and to a linking member and may preferably be a hydraulic ram or may be controlled by a rotatory actuator.

According to some examples, the first aerofoil element section is thicker than the second aerofoil element section.

According to some examples, the first aerofoil element is the same length or shorter than the second aerofoil element.

According to some examples, the maximum thickness of the first aerofoil element and the maximum thickness of the second aerofoil element is within the leading half of the elements chord length, and where the curvature of each aerofoil section is convex along its total length and does not include any inflections According to some examples, a linking member which is rotational about two or more rotational bearings connecting it to a first aerofoil element. Preferably the leading element will comprise bearings both above and below each linking bar and preferably these bearings should be fixed to the torsional spar in between each bar.

According to some examples, a second element which may comprise a top section and a base section connected by a torsional spar or torsional structure. A linking member may be fixed to the second element by way of two or more rotational bearings preferably connected to the torsional spar of the second element.

According to some examples, the first element is a leading element.

According to some examples, the second element is a trailing element,

According to some examples, the wingsail comprises a double hinged mechanism.

According to a third aspect, there is provided a method of minimising stowed dimensions of a double element wingsail, comprising: folding a first element by 180-degree rotation over a second element, wherein each element comprises an aerofoil.

According to some examples, the folding occurs over two rotation axis.

According to some examples, a first rotation axis is part of a first aerofoil element, and a second rotation axis is part of the second aerofoil element.

According to a fourth aspect, there is provided a wingsail comprising: a first aerofoil element; and a second aerofoil element; wherein the second aerofoil element is configured to rotate relative to the first aerofoil element about a first rotation axis from a first position to a second position; wherein in the first position, the first aerofoil element is in front of the second aerofoil element and a chord line of the first aerofoil element is aligned and in parallel with a chord line of the second aerofoil element; wherein in the first position, the first rotation axis is positioned in front of the second aerofoil element and behind a front edge of the first aerofoil element; wherein the second aerofoil element is further configured to rotate relative to the first aerofoil element about a second rotation axis from the second position to a third position; wherein in the first position, the second rotation axis is positioned behind the first aerofoil element and in front of a rear edge of the second aerofoil element.

According to some examples, a fourth position the chord line of the second aerofoil element is at an angle of 45 degrees to the chord line of the first aerofoil element and wherein the second aerofoil element is configured to: rotate, relative to the first aerofoil element and in a first rotational direction, from the fourth position to the first position;

rotate, relative to the first aerofoil element and in the first rotational direction, from the first position to the second position; rotate, relative to the first aerofoil element and in the first rotational direction, from the second position to the third position, wherein in the third position the chord line of the second aerofoil element is at an to an angle of approximately 180 degrees to the chord line of the first aerofoil element; such that the chord length of the second aerofoil element is configured to rotate approximately 225 degrees relative to the first aerofoil element during rotation from the fourth position to the third position.

According to some examples, when the second aerofoil element is in the first position, the second aerofoil element is configured to: rotate, in a second rotational direction opposite to the first rotational direction, around the first axis of rotation from the first position to the fourth position; and rotate, in the first rotational direction, around the first axis of rotation from the first position to the second position, wherein in the second position the chord line of the second aerofoil element is at an angle of approximately 90 degrees to the chord line of the first aerofoil element; such that the chord length of the second aerofoil element is configured to rotate approximately 135 degrees relative to the first aerofoil element during rotation from the fourth position to the second position.

According to some examples, a slot is formed between the first aerofoil element and the second aerofoil element when the second aerofoil element is rotated from the first position in the first rotational direction or in the second rotational direction, wherein the slot comprises a cavity allowing energy flow from a pressure side of the wingsail to a suction side of the wingsail when the wingsail meets a wind flow.

According to some examples, the second aerofoil element is configured to rotate beyond the second position in the first rotational direction around the second axis of rotation to move the second aerofoil element to the third position.

According to some examples, the wingsail comprises: a first ram connecting the first aerofoil element and the second aerofoil element, wherein the ram is configured to limit rotation for the second aerofoil element about the first axis of rotation according to an extent of movement of the first ram; at least one of a second ram, and a rotary actuator configured to, at the extent of the movement of the first ram, rotate the second aerofoil element about the second axis of rotation.

According to some examples, when the second aerofoil element is in the second position, the chord line of the first aerofoil element and the chord line of the second aerofoil element are approximately perpendicular.

According to some examples, when the second aerofoil element is in the third position, a total chord length of the wingsail is minimised, wherein the total chord length comprises a length of the chord line from a front edge to a rear edge of the wingsail, wherein the total chord length of the wingsail is the sum of the chord lengths of the first and second elements.

According to some examples, the wingsail comprises a double-hinged mechanism, wherein the double-hinged mechanism provides the first axis of rotation and the second axis of rotation.

According to some examples, the wingsail comprises a base connected to the first aerofoil element, wherein the base is configured to connect the wingsail to a marine vessel.

According to some examples, the wingsail comprises a linking member for connecting the second aerofoil and the first aerofoil element via one or more independently rotating linking members, the linking member comprising: one or more bars connecting the first aerofoil element and the second aerofoil element; and a torsional spar connecting the two or more bars so that each bar cannot rotate independently of any of the one or more bars.

According to some examples, the linking member is configured to rotate relative to the first aerofoil element around two or more rotational bearings.

According to some examples, the wingsail comprises a torsional spar configured to connect each of the bars, wherein for each of the two or more bars: one of the two or more rotational bearings are connected to a torsional spar above the bar and one of the two or more rotational bearings are connected to the torsional spar below the bar.

According to some examples, a second element is rotatable relative the linking member about two or more further bearings.

According to some examples, at least one of the two or more rotational bearings and the two or more further bearings comprise self-aligning bearings.

According to some examples, the linking member is rotational relative to the first aerofoil element and the second aerofoil element is rotational relative to both the first aerofoil element and the linking member.

According to some examples, the wingsail comprises: a first linear actuator for controlling a rotation of the linking member relative to the first aerofoil element According to some examples, the wingsail comprises: a second linear actuator for controlling a rotation of the second aerofoil element relative to the linking member.

According to some examples, at least one of the first linear actuator and the second linear actuator comprises a hydraulic ram.

According to some examples, the wingsail comprises: a hydraulic motor for controlling a rotation of the second aerofoil element relative to the linking member.

According to some examples, the first aerofoil element section is thicker than the second aerofoil element section.

According to some examples, the first aerofoil element is the same length or shorter than the second aerofoil element.

According to some examples, a maximum thickness of the first aerofoil element is within a front half of the chord length of the first aerofoil element, and wherein a maximum thickness of the second aerofoil element is within a front half of the chord length of the second aerofoil element.

According to some examples, the curvature of the leading edge of each aerofoil element is convex.

According to some examples, a pressure is created in a cavity in the first and or second aerofoil element and high-pressure airstream is directed to the suction side of the aerofoil. Wherein the high-pressure airstream is distributed by one or more channels within the respective aerofoil element According to some examples suction is created within a cavity of the second aerofoil element and inlet holes on the surface of the element allow air to be sucked from the external boundary layer into the internal cavity of the second aerofoil element.

According to a fifth aspect, there is provided a method comprising: rotating a second aerofoil element relative to a first aerofoil element about a first rotation axis from a first position to a second position, wherein in the first position, the first aerofoil element is in front of the second aerofoil element and a chord line of the first aerofoil element is aligned and in parallel with a chord line of the second aerofoil element; wherein in the first position, the first rotation axis is positioned in front of the second aerofoil element and behind a front edge of the first aerofoil element;

and rotating the second aerofoil element relative to the first aerofoil element about a second rotation axis from the second position to a third position; wherein in the first position, the second rotation axis is positioned behind the first aerofoil element and in front of a rear edge of the second aerofoil element.

According to a sixth aspect, there is provided a method comprising using the wingsail of any of the above described first to fourth aspects, or their examples.

According to a seventh aspect, there is provided a method of manufacturing the wingsail of any of the above described first to fourth aspects, or their examples.

According to an eighth aspect, there is provided a base structure for a wind propulsion system, the base structure comprising: a platform; and three or more pillars supporting the platform, each of the three or more pillars having a height between two metres and four metres, wherein the wind propulsion system is positioned above the platform.

According to some example, the base structure comprises a linear actuator for raising and lowering the wind propulsion system, the linear actuator being positioned above the platform.

DETAILED DESCRIPTION

According to some examples, a wingsail and a method for operating a wingsail is described. The wingsail may be used for a watercraft. A watercraft may comprise, for example, at least one of: a marine vessel, a boat, a ship. In some examples, the watercraft may comprise a powered watercraft. In some examples, the watercraft may comprise a commercial vessel such a bulk carrier or a product tanker.

According to some examples, a wingsail may be positioned on a surface of a watercraft, for example on the deck of a watercraft.

An exemplary wingsail may be rigid. The wingsail may be fitted to a marine vessel (e.g., a powered watercraft, a ship, etc.). A wingsail may be considered to be a variable-camber aerodynamic structure that is fitted to a vessel, e.g., a marine vessel.

A typical marine vessel length to be fitted with these units may be between 150 m and 360 m but may also be fitted to a smaller or larger vessel. In some examples, the wingsail is used to produce thrust which is transferred to the vessel to propel it forwards and reduce the thrust required from the ship's engine. In some examples, this can reduce the power required from the main engine and reduces fuel consumption and carbon emissions by around 20-30%, dependent on vessel type, route, number of wingsail units and other considerations.

Some example wingsails described herein may comprise at least two wingsail elements. Each wingsail element may comprise a leading edge and a trailing edge. Each wingsail element may have an aerodynamic shape (for example, a shape similar to the shape of aerofoil element 103 or aerofoil element 105 in FIG. 1). The aerodynamic shape of each wingsail element may generate a lift force when air flow passes over the surface of the respective wingsail element. Each wingsail element may comprise an aerofoil.

According to some examples, the leading edge of each aerofoil is closer to the broadest part of the aerofoil, while the trailing edge of each aerofoil is further from the broadest part of the aerofoil. Other example shapes may be used for the aerofoils, however.

The wingsail may incorporate boundary layer flow control. A boundary layer of a wingsail may be considered to comprise a thin layer of air flowing over the surface. According to some examples, the flow of air in the boundary layer is controlled to prevent separation of air flow over the wingsail and thus reduce the wingsails propensity to stall. This enables a greater achievable lift of the wingsail.

Figure 1:
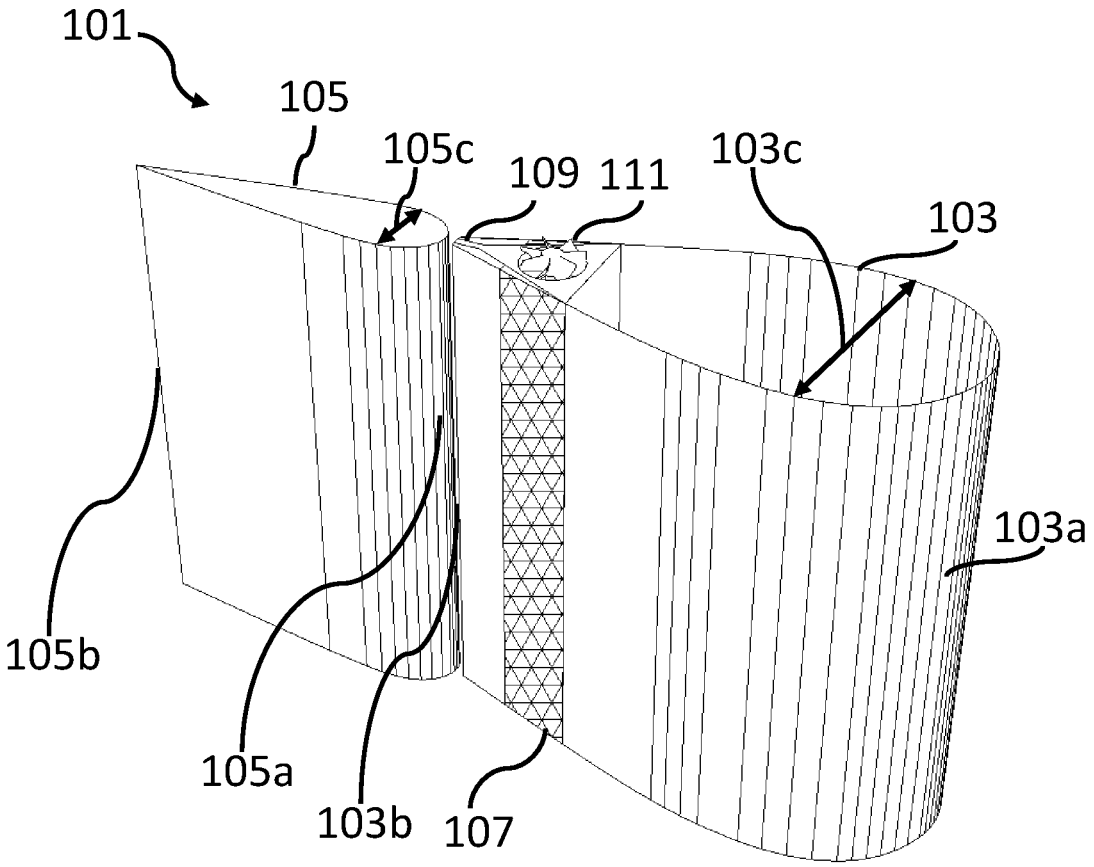
FIG. 1 shows a perspective view of a wingsail.

FIG. 1 shows a perspective view of an example wingsail 101. Wingsail 101 is a double element wingsail having a first aerofoil 103 and a second aerofoil 105. One of the double elements of wingsail 101 is first aerofoil 103 and one of the double elements of wingsail 101 is second aerofoil 105. First aerofoil 103 comprises a leading edge 103*a*, a trailing edge 103*b* and a section 103*c* of maximum cross-sectional width. As can be seen in the example of FIG. 1, leading edge 103*a* is closer to section 103*c* of maximum cross-sectional width than trailing edge 103*b*. A portion of aerofoil 103 comprising leading edge 103*a* is rounded, and a portion of aerofoil 103 comprising trailing edge 103*b* is pointed (or may be a rounded shape which has a radius smaller than that of the leading-edge curvature). In some examples, the portion of aerofoil 103 comprising leading edge 103*a* has a wider cross-sectional width than the portion of aerofoil 103 comprising trailing edge 103*b*. It is envisaged that other shapes may be used for first aerofoil 103, however.

Second aerofoil 105 comprises a leading edge 105*a*, a trailing edge 105*b* and a section 105*c* of maximum cross-sectional width. Leading edge 105*a* is closer to section 105*c* of maximum cross-sectional width than trailing edge 105*b*. A portion of aerofoil 105 comprising leading edge 105*a* is rounded, and a portion of aerofoil 105 comprising trailing edge 105*b* is pointed. It is envisaged that other shapes may be used for first aerofoil 103, however.

Figure 2:
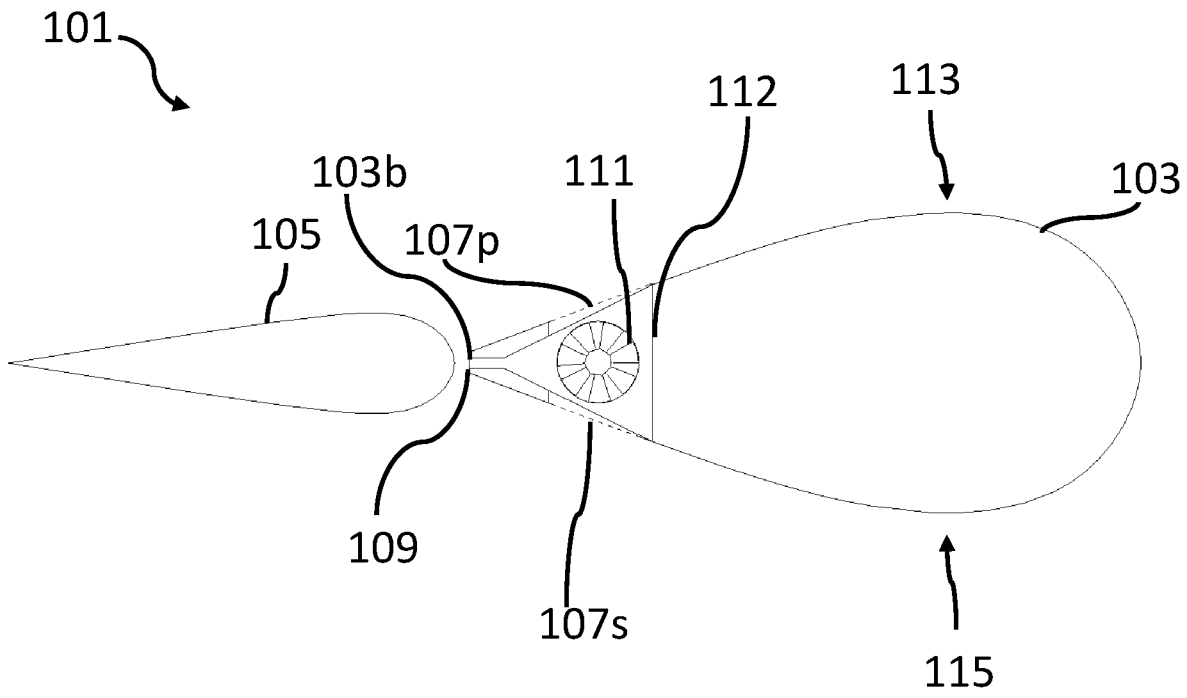
FIG. 2 shows a horizontal cross-section of a wingsail.

Second aerofoil 105 may be symmetrical along a chord line of second aerofoil 105, as shown in FIGS. 1 and 2 for example.

First aerofoil 103 may be symmetrical along a chord line of second aerofoil 105, as shown in FIGS. 1 and 2 for example.

A chord line of an aerofoil may be considered to be a longitudinal axis from the leading edge to the trailing edge of the aerofoil.

Leading edge 103*a* may be considered to be at a nominal "front" of wingsail 101. Trailing edge 103*b* is behind leading edge 103*a*. In the feathered configuration of FIG. 1, the second aerofoil 105 is behind the first aerofoil 103, and the leading edge 105*a* of the second aerofoil 105 is in front of the trailing edge 105*b* of the second aerofoil 105.

Aerofoils 103 and 105 have "teardrop" shapes but other aerodynamic shapes may be used. In general, an aerofoil such as aerofoils 103 or 105 can have any shape that produces an aerodynamic reaction (lift) perpendicular to the direction of air flow over it, for a small resistance (drag) force in the direction of air flow.

The wingsail device 101 may rotate around its base to vary an angle of attack to the apparent wind direction. In this way, wingsail device 101 can optimise lift produced. The lift is generated by the creation of a pressure differential between either side of wingsail 101, leading to a high pressure and a low-pressure side due to a difference in air velocity over each side of the wingsail device 101. Apparent wind is the wind that a moving watercraft experiences. Apparent wind is a combination of the wind experienced because of forward motion of the ship combined with the prevailing wind. The two vectors combine to produce 'apparent wind' which may have a different angle and wind speed than the wind experienced because of the forward motion of the ship and the prevailing wind.

The second aerofoil 105 is rotatable relative to the first aerofoil 103, allowing the camber of the device 101 to be adjusted and inverted.

When the wingsail device 101 is on a port tack (when the apparent wind is hitting the port side of the device 101) the second aerofoil 105 can be rotated to the port side relative to the first aerofoil 103.

When the wingsail device 101 is on a starboard tack (when the apparent wind is hitting the starboard side of the device) the second aerofoil 105 is rotated to the starboard side relative to the first aerofoil 103.

When second aerofoil 105 is rotated relative to first aerofoil 103, as seen for example in FIGS. 4, 5, 6, 6, 7, 13, 14A and 14B, the chord lines of the first aerofoil 103 and second aerofoil 105 are not parallel. This provides a cambered configuration for the wingsail device 103. This can be achieved by rotating the second aerofoil 105 relative to first aerofoil 103.

In a cambered configuration of device 101, a slot is formed between the first aerofoil 103 and the second aerofoil 105. This slot allows a high-pressure stream of air to flow from the high-pressure side to the surface of the low-pressure side. This re-energises the flow travelling over the second aerofoil and allows the flow to stay attached at more extreme angles of attack and avoid stall of the wingsail, allowing greater lift coefficients to be achieved.

In some examples, wingsail 101 can be fitted with a pressure differential generator 111 (as shown in FIG. 1, for example). Pressure differential generator 111 can be used to provide control of the flow of air around the device 101. This controlled flow allows the device to be used at a greater angle of attack and greater camber angle without stalling, thus greatly increasing the achievable lift coefficients for wingsail 101. In some examples pressure differential generator may comprise one or more rotary blades (e.g., fan blades) which may be connected by a shaft.

To provide control of airflow around wingsail 101, air inlet 107 draws air into an interior of wingsail 101. Wingsail 101 may also comprise an outlet 109. In some examples, for example as shown in FIGS. 1 and 2, outlet 109 may be positioned at a trailing edge 103*b* of first aerofoil 103. However, it will be appreciated that in other examples outlet 109 may be positioned at other positions in first aerofoil 103.

Air drawn in at inlet 107 can be directed through an interior channel 119 inside of aerofoil 103. The interior channel 119 connects air inlet 107 and air outlet 109. Air outlet 109 emits air flow, which may comprise a focused jet of air, out of aerofoil 103. This air flow may be directed towards the surface of the second aerofoil element 105. In the example of FIGS. 1 and 2, the air flow can be emitted out of outlet 109 at trailing edge 103*b* of first aerofoil 103 towards and onto a leading edge 105*a* of aerofoil 105.

Pressure differential generator 111 may be powered by one or more motors. These motors may comprise hydraulic or electric motors, for example. When operated, pressure differential generator 111 may create an area of low pressure at inlet 107 of channel 119 such that air is sucked in, and an area of high pressure at outlet 109 of channel 119 such that air is pushed out of outlet 109.

Pressure differential generator 111 may be configured to create negative internal pressure in the first aerofoil, wherein the negative internal pressure draws air into the main body of the first aerofoil through air inlet 107.

Pressure differential generator 111 may comprise, for example, a fan driven by a motor; or a series of fans connected by one fan shaft and driven by a motor.

According to some examples, flow hits the leading edge of the first aerofoil element 103 and flows around the surface (on both sides). As air flow travels over the low pressure surface the laminar boundary layer starts to transition into turbulent flow, if the angle of attack of the device 101 is increased at this point the flow will separate and the device 101 will stall.

So that the device 101 can operate at higher angles of attack (and therefore generate more lift), in some examples the air traveling over the surface of the front aerofoil 103 is sucked internally at a location near the back end of the front aerofoil 103. This removes part of the turbulent boundary layer and keeps the flow attached at higher angles of attack, thus achieving greater producible thrust of device 101.

A second aerofoil 105 is located behind the first aerofoil 103 and when aerofoil 105 is cambered it produces a slot between the first aerofoil 103 and second aerofoil 105. This slot allows a high-pressure jet of air from the high-pressure side (113 in FIG. 6, 115 in FIG. 7) to the low-pressure side (115 in FIG. 6, 113 in FIG. 7) allowing the flow again to stay attached at higher angles of attack and camber angles-which in a similar way means that the device can produce greater thrust to the vessel.

An air outlet 109 may be positioned at the trailing edge of the first aerofoil element 103 to further enhance the high-pressure jet of air traveling through the slot and thus allow the wingsail 101 to maximise the achievable angle of attack before stall and maximise the thrust produced whilst also reducing drag.

As such, by using at least one inlet 103 and at least one outlet 109 on the first aerofoil 103 higher angles of attack of device 101 can be achieved without stalling. Additionally, or alternatively, higher angles of attack of device 101 can be achieved without stalling by cambering second aerofoil 105 relative to first aerofoil 103.

FIG. 2 shows a cross sectional plan view of wingsail 101. As shown in FIG. 2, air inlet 107 comprises two air inlets 107*s* and 107*p* provided on both sides 113 and 115 (the port side 113 and the starboard side 115, respectively) of first aerofoil 103. In the example of FIG. 2, air inlet 107 is situated towards trailing edge 103*b* of first aerofoil 103. Each air inlet 107 may comprise a vertical strip (or vertical strips) allowing air to flow into aerofoil 103. The vertical strip(s) may comprise a gap in the device allowing air to flow in. In other examples, the air inlet may comprise a surface with cut openings (such as circular holes or other shapes) or other porous material allowing air to flow into the first aerofoil 103. This surface with cut shapes or porous material controls the speed and volume of air flow into the wingsail to optimize the aerodynamics of the device. It also brings the added benefit that it can prevent debris being sucked into the interior of aerofoil 103.

Air inlet 107 draws in unstable flow close to the surface of the device 101 into the main body of the first aerofoil 103 which allows the flow to stay attached at greater angles of attack, thus leading to greater lift coefficients being produced.

In the example of FIG. 2, a partition 112 is provided between the main body of aerofoil 103 and pressure differential generator 111. In this way, air flow generated affects internal air flow in a portion at the trailing edge 103*b* of the device, but air flow generated from pressure differential generator 111 is prevented from affecting internal air flow within the main body (i.e., in the body positioned at the leading edge 103*a*) of aerofoil 103.

FIGS. 3 to 7 show examples of a wingsail 101 under the influence of wind 130. Although wingsail 101 is shown in this figure, the same principles may be applied to wingsail 401, 621 or any other wingsail described herein.

When wind direction 130 is directed directly at the leading edge of a front aerofoil 103 of wingsail 101 (i.e., the wind direction is directed between the port side 113 and the starboard side 115 of the wingsail), wingsail 101 may be arranged in a feathered configuration. In this configuration, the chord line of aerofoil 103 and aerofoil 105 are aligned and in parallel with one another.

Figure 4:
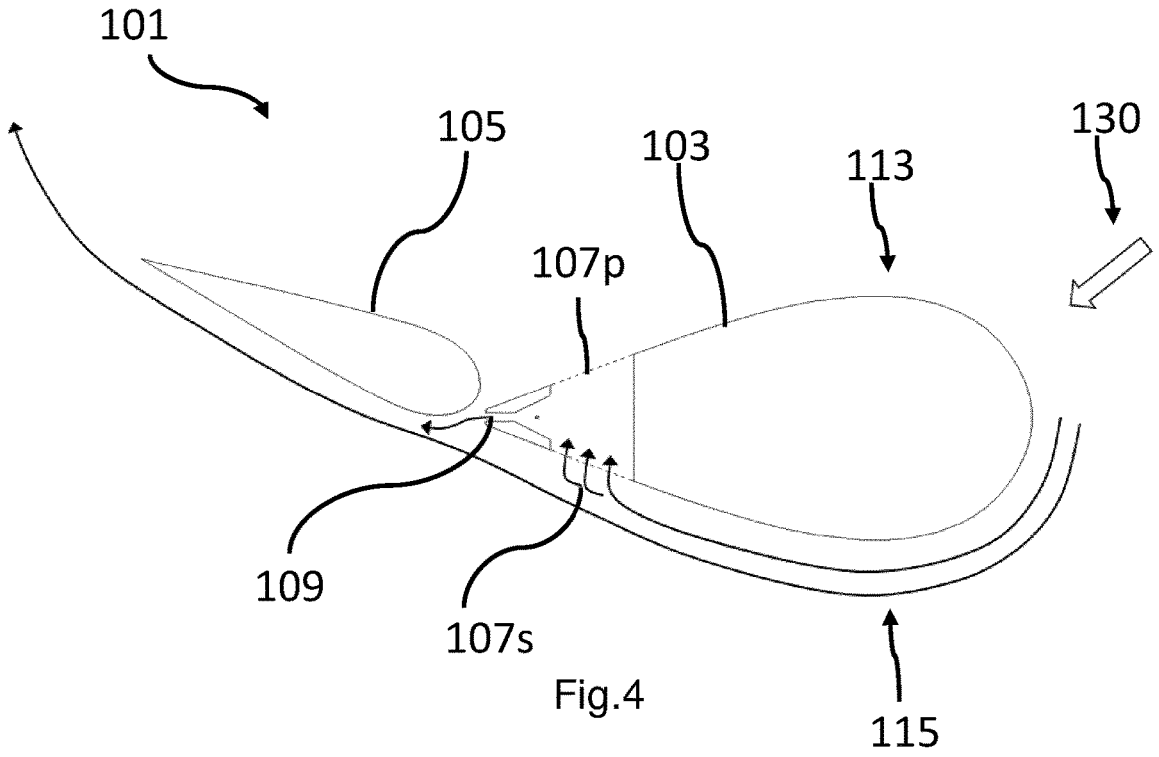
FIG. 4 shows a plan view of a wingsail on a port tack in a cambered configuration.

FIG. 4 shows an example of a wingsail 101 on a port tack. When wingsail 101 is working on a port tack, i.e., when the apparent wind 130 is crossing the port side of the vessel on which wingsail 101 is fitted, the angle of attack of wingsail 101 can be configured so that the apparent wind 130 is directed to the port leading edge of wingsail 101. Wingsail 101 can be cambered in a port configuration where the second aerofoil 105 is rotated to the port side 113 relative to the first aerofoil 103. In the port configuration, the starboard air inlet 107*s* is open and the port air inlet 107*p* is closed. The air outlet 109 of the first aerofoil 103 directs air flow onto the starboard leading edge of the second aerofoil 105, thus re-energising the air flow at this critical point and increasing the stall angle of the device 101.

Figure 5:
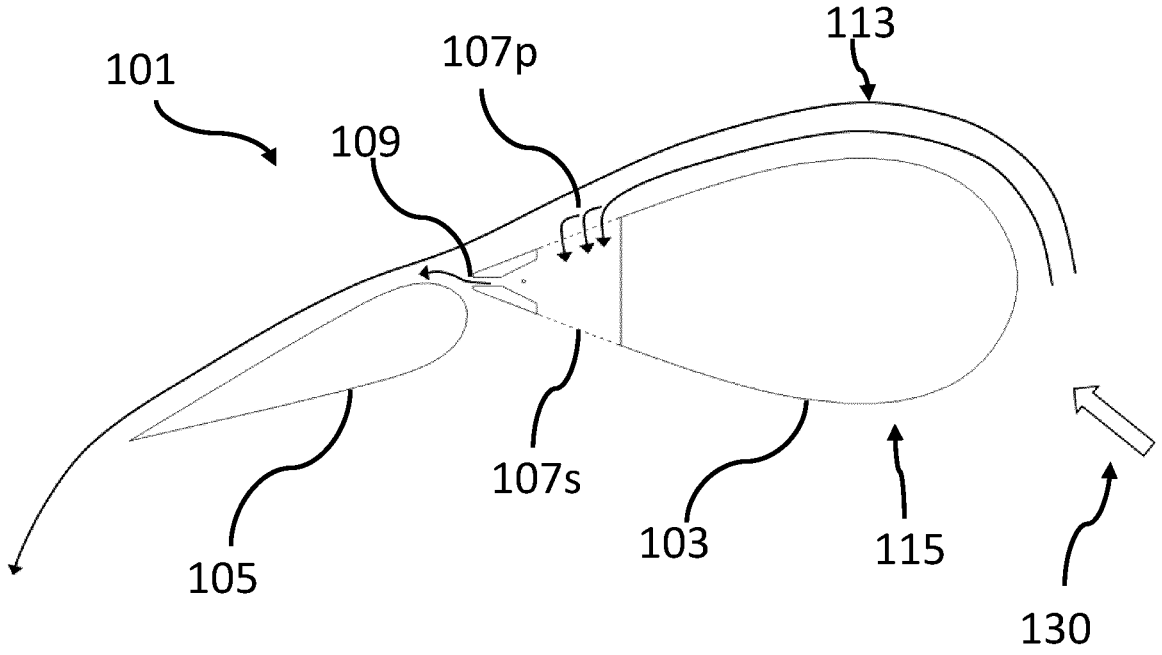
FIG. 5 shows a plan view of a wingsail on a starboard tack in a cambered configuration.

FIG. 5 shows an example of a wingsail 101 on a starboard tack. When wingsail 101 is working on a starboard tack, i.e., when the apparent wind 130 is crossing the starboard side of the vessel on which wingsail 101 is placed, the angle of attack of wingsail 101 can be configured so that the apparent wind 130 is directed to the starboard leading edge of wingsail 101. Wingsail 101 can be cambered in a port configuration where the second aerofoil 105 is rotated to the starboard side 115 relative to the first aerofoil 103. In the starboard configuration, the starboard air inlet 107*s* is closed and the port air inlet 107*p* is open. The air outlet 109 of the first aerofoil 103 directs air flow onto the port leading edge of the second aerofoil 105, thus re-energising the air flow at this critical point and increasing the stall angle of the device 101.

Figure 6:
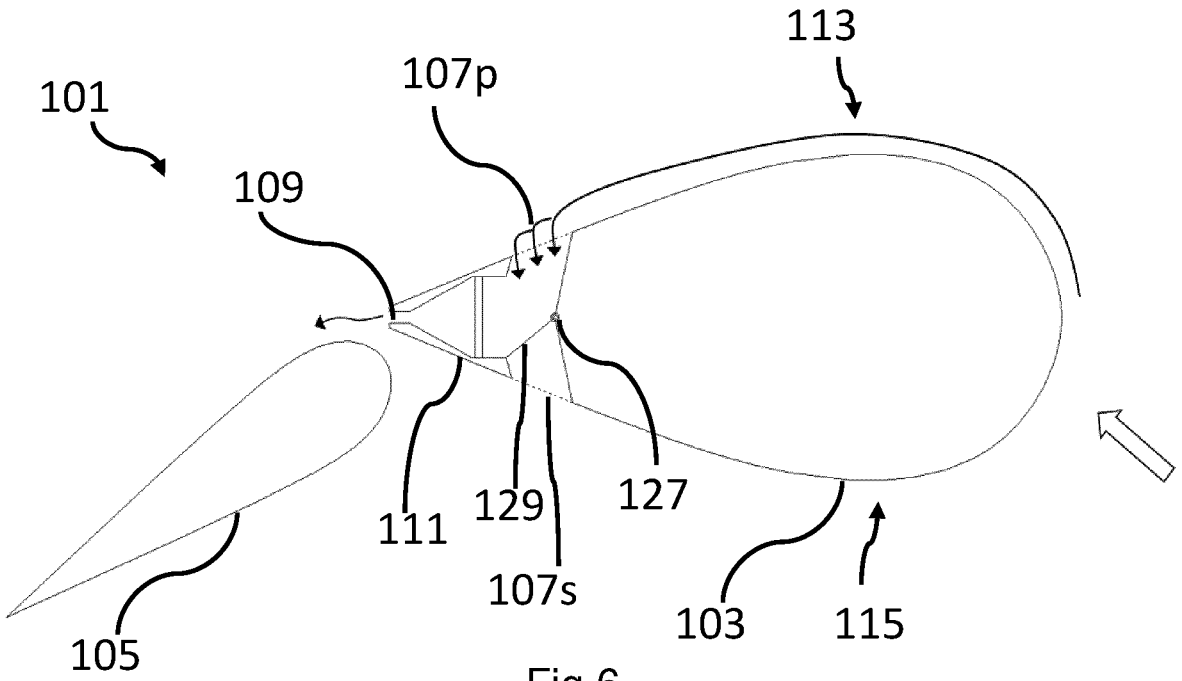
FIG. 6 shows an interior view of a wingsail on a starboard tack in a cambered configuration.

FIG. 6 shows an example of how a starboard air inlet 107*s* can be closed during a starboard tack while a port air inlet 107*p* is open. An interior wall 129 is positioned to close a starboard air inlet 107*s* while a port air inlet 107*p* is left open. Interior wall 129 can be rotated around a rotation point 127. This rotation can be performed using a motor, for example an electric or hydraulic motor. Rotation may be performed automatically based on detection by a computer system of wingsail 101 of whether wingsail 101 is on a port or starboard tack. In some examples, the rotation may be performed based on a user input into a computer system. In other examples, the rotation is performed based on a manual operation of a user of wingsail 101. When wingsail 101 is being used on a starboard tack, wingsail 101 may draw air in the port air inlet 107*p* and not draw air in the starboard air inlet 107*s*.

Figure 7:
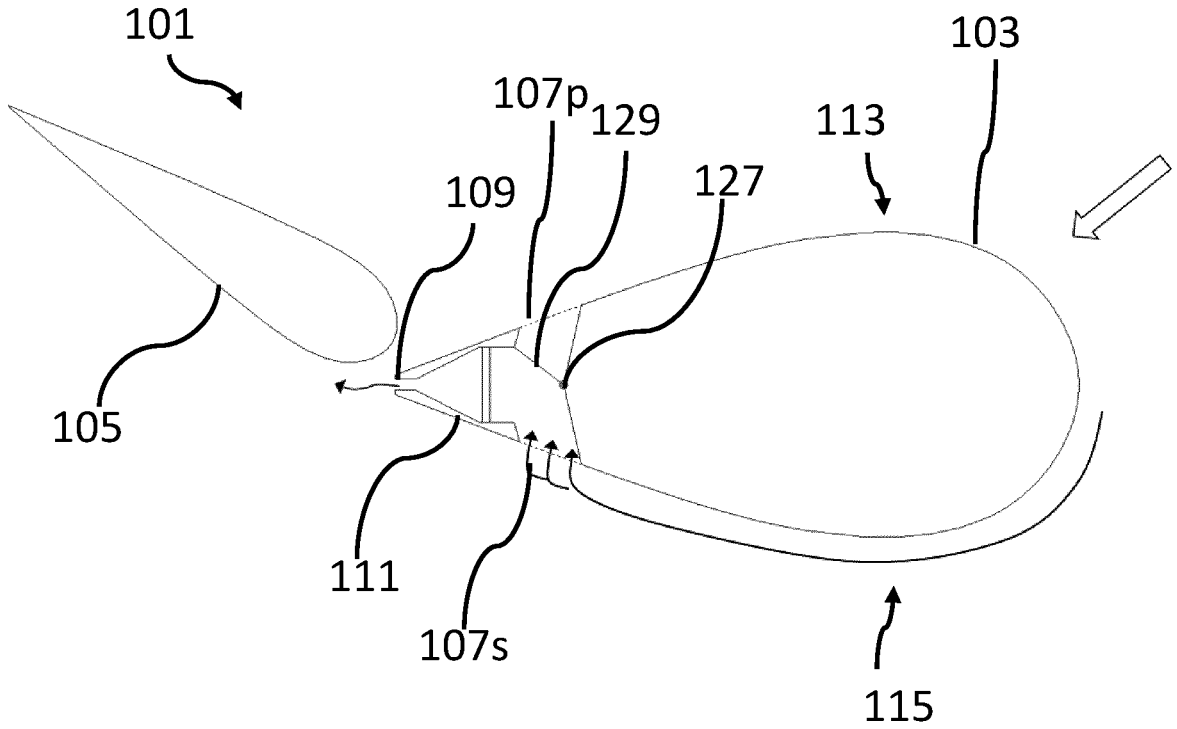
FIG. 7 shows an interior view of a wingsail on a port tack in a cambered configuration.

FIG. 7 shows an example of how a starboard air inlet 107*s* can be open during a port tack while a port air inlet 107*p* is closed. Wingsail 101 may be operated to move between the configuration of FIGS. 6 and 7. An interior wall 129 is positioned to close a port air inlet 107*s* while a port air inlet 107*p* is left closed. Interior wall 129 can be rotated around a rotation point 127. This rotation can be performed using a motor, for example an electric or hydraulic motor. Rotation may be performed automatically based on detection by a computer system of wingsail 101 of whether wingsail 101 is on a port or starboard tack. In some examples, the rotation may be performed based on a user input into a computer system. In other examples, the rotation is performed based on a manual operation of a user of wingsail 101. When wingsail 101 is being used on a port tack, wingsail 101 may not draw air in the port air inlet 107*p* and draw air in the starboard air inlet 107*s*.

A computer system as described herein may comprise at least one processor and an associated memory. The computer system may be used to run control software for opening and closing at least one inlet of wingsail 101.

Figure 3:
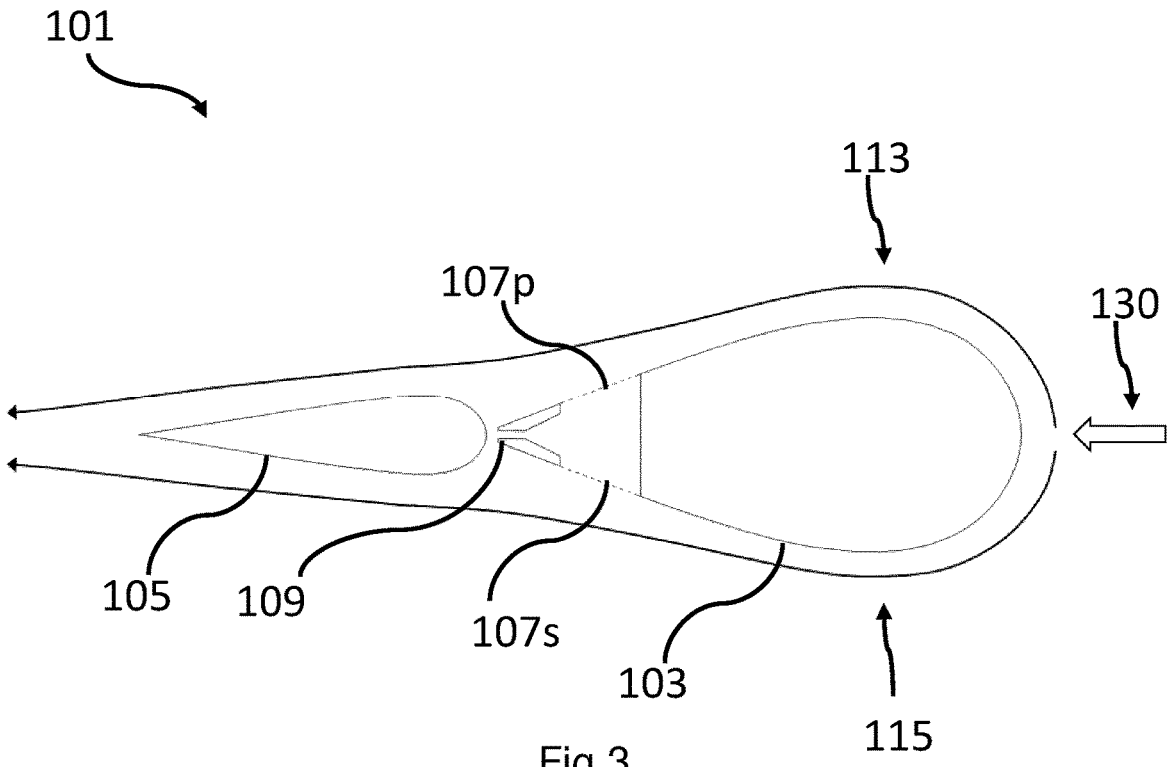
FIG. 3 shows a plan view of a wingsail in a feathered configuration.
Figure 8:
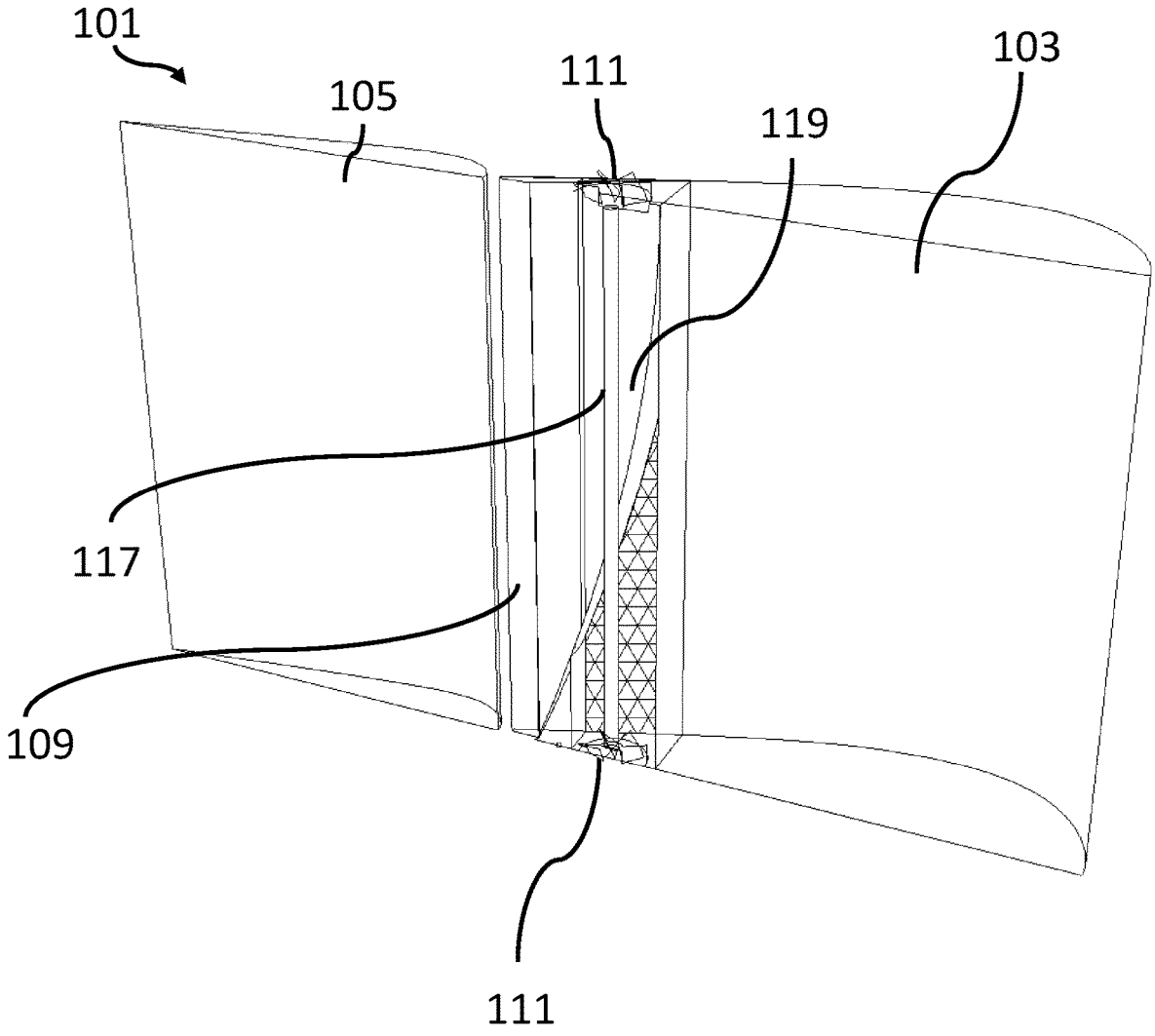
FIG. 8 shows a vertical cross-section of a wingsail.
Figure 10:
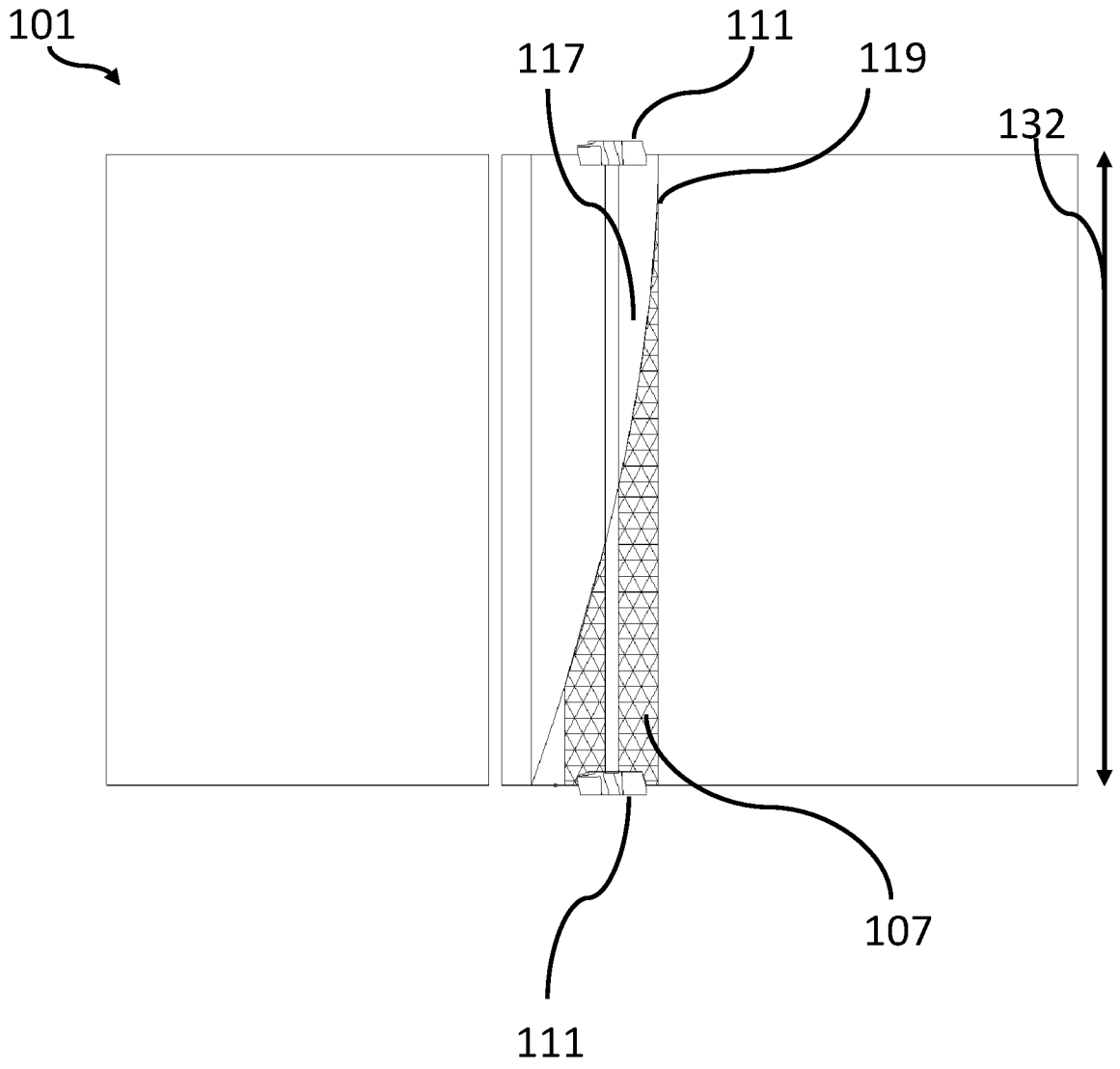
FIG. 10 shows a vertical cross-section of a wingsail.

FIG. 8 shows a cross section through the centre of wingsail 101, in a configuration where the chord lines of aerofoil 103 and aerofoil 105 are aligned and parallel. FIG. 10 also shows a side view of a cross section of wingsail 101. As can be seen in FIGS. 8 and 10, an internal air vent 119 (a channel) connects air inlet 107 to air outlet 109. In the example of FIG. 3, the air outlet is positioned at the trailing edge of aerofoil 103. The channel 119 may be configured to direct flow from the inlet 107 at a first position along a span of the wingsail 101 and directs this flow to the air outlet 109, wherein the span of the wingsail 101 is a distance from a base of the wingsail 101 to a tip of the wingsail 101.

The volume of the air vent is lower at the air outlet 109 than at the air inlet 107. The air from pressure differential generator 111 is focused as it travels to air outlet 109 by a reduction in volume of internal air vent 119 from the pressure differential generator 111 to air outlet 109, this giving a higher concentration of energized flow which is directed towards the second aerofoil. Air is emitted out of air outlet 109 as a focused stream of air where it flows towards the surface of second aerofoil element 105. In some examples, second aerofoil 105 may be in a cambered configuration. The focused airflow from air outlet 109 re-energises the boundary layer thus allowing the flow to stay attached at greater camber angles and angles of attack, thus increasing the stall angle, and increasing the maximum achievable lift coefficient of wingsail 101.

Figure 9:
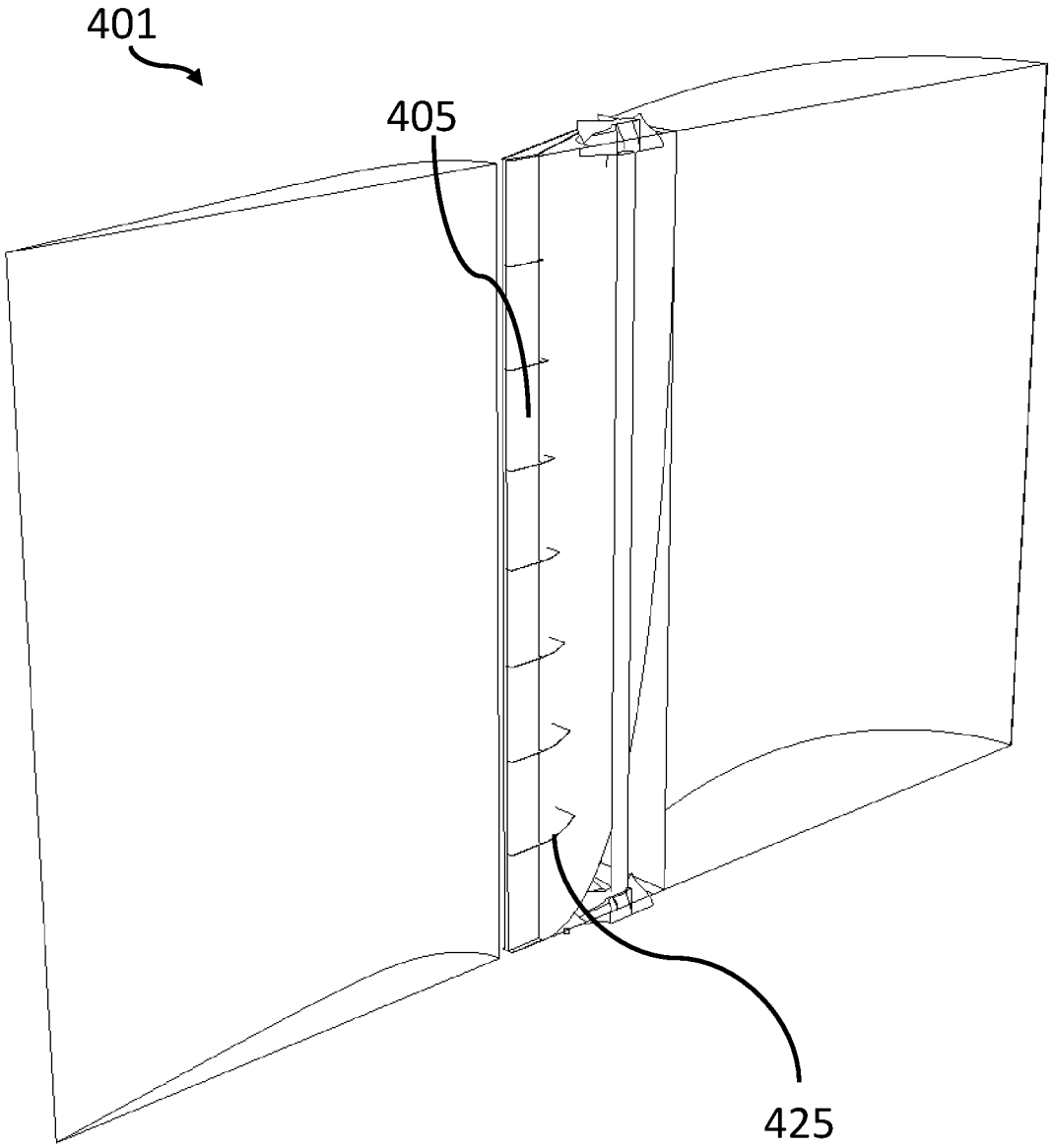
FIG. 9 shows a vertical cross-section of a wingsail.

In the examples of FIGS. 8, 9 and 10 channel 119 is sloped so that the channel is longer along a vertical axis 132 of wingsail 101 at air outlet 109 than at air inlet 107. Vertical axis 132 is shown in FIG. 10. This sloped channel shape is useful when wingsail modules such as wingsail 101 are stacked on top of each other, as discussed further below with reference to FIGS. 11 and 12. In this example, wingsail modules having the channel shape (the shape of 117) can be stacked upon each other to create a larger wingsail comprising multiple modules. In this case will direct air flow from the air inlet of a higher modular section through a pressure differential generator to the air outlet of a lower modular section. Other channel shapes can be used to provide alternative outcomes, however. For example, if the channel is sloped so that the channel is longer along a vertical axis 132 of wingsail 101 at air inlet 107 than at air outlet 109, air flow will be directed from the air inlet of a lower modular section through a pressure differential generator to the air outlet of a higher modular section. Further, non-sloped (substantially straight, or straight, along a vertical axis 132) channels may be used to direct air flow to an air inlet of a modular section through a pressure differential generator to the air outlet of a same modular section.

In situations where the wingsail is comprised of a single unit (e.g., wingsail 101 of FIG. 1), any of the above-described three channel shapes may be used. In some examples, a non-sloped channel may be used for a single unit such that the internal air flow would travel from an air inlet at one level through a pressure differential generator and exit at an air outlet at the same level.

According to some examples, a modular wingsail (e.g., wingsail 621) may be made of two or more internal modules covered by an outer shell.

According to some examples, wingsail 101 may have a similar dimension to 101, having a greater height than length.

FIG. 9 shows a cross section through a centre of an example portion of wingsail 401, in a configuration where the chord lines of a front aerofoil and a rear aerofoil of wingsail 401 are aligned and in parallel. Wingsail 401 may comprise a similar structure as wingsail 101. Wingsail 401 additionally includes at least one air flow straightener 425 positioned at an air outlet 405 of the front aerofoil of wingsail 401 to allow the flow to exit the air outlet in a controlled fashion, to maximise an aerodynamic benefit of the controlled airflow. Additionally, or alternatively, at least one air flow straightener may be positioned at an air inlet of the front aerofoil. Further, instead, or additional to at least one air flow straightener being positioned at an air inlet or an air outlet of the front aerofoil of wingsail 401, at least one air flow straightener may be positioned between the air inlet and air outlet of wingsail 401. An air flow straightener may comprise one or more walls placed along an air inlet, air outlet or channel connecting an air outlet and air inlet.

Figure 11:
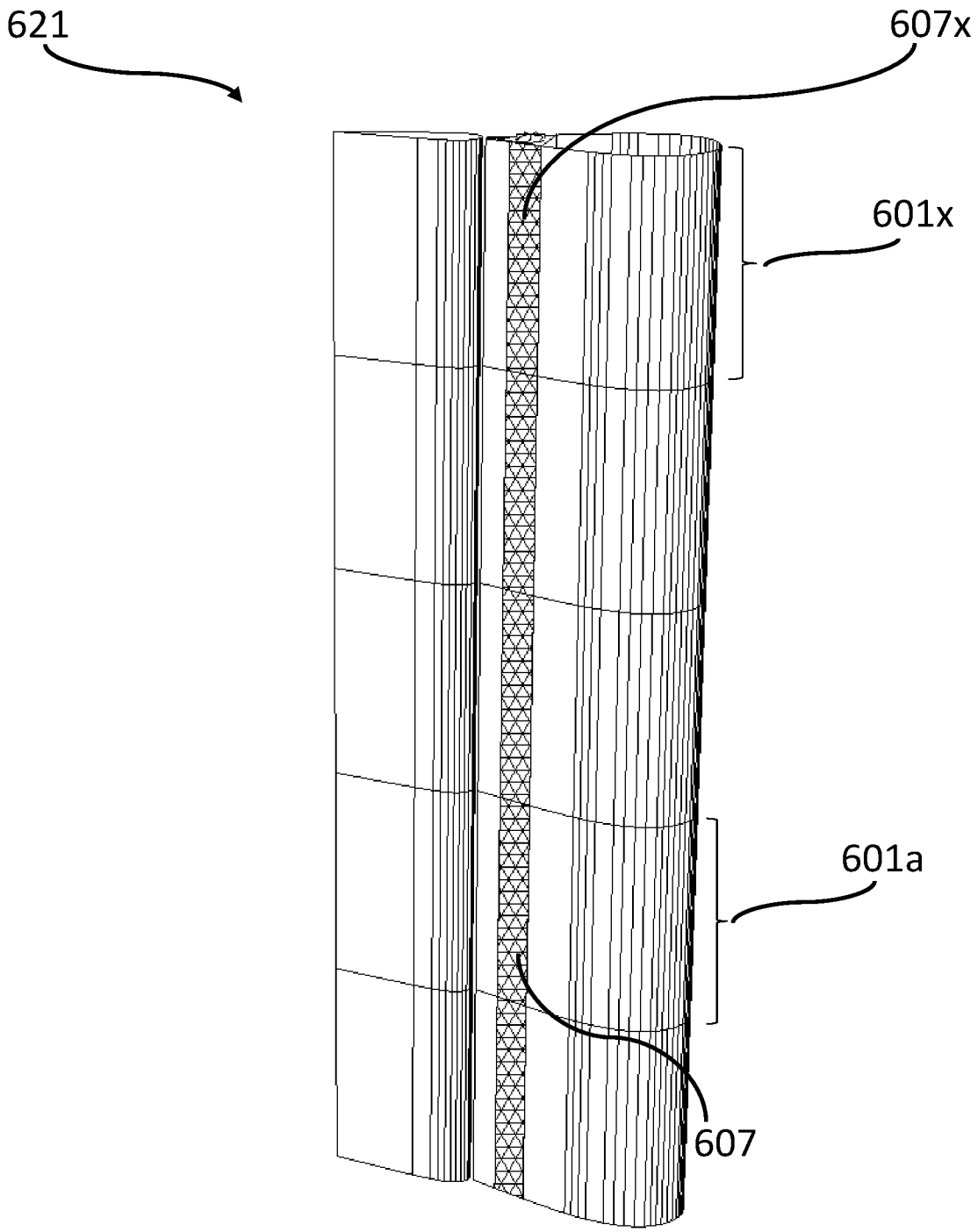
FIG. 11 shows an exterior view of a modular wingsail.

As shown in FIG. 11, in some examples, wingsail modules such as wingsail module 601*a* and 601*x* may be stacked on top of one another to form a wingsail 621. Each wingsail module 601*a*, 601*x* etc. may comprise a similar structure to wingsail 101, wingsail 401 or any other wingsail described above.

Each wingsail module 601 may comprise an air inlet 607, an air outlet and a pressure differential generator. Each wingsail module 601 may be configured to be stacked on top of one another.

Figure 12:
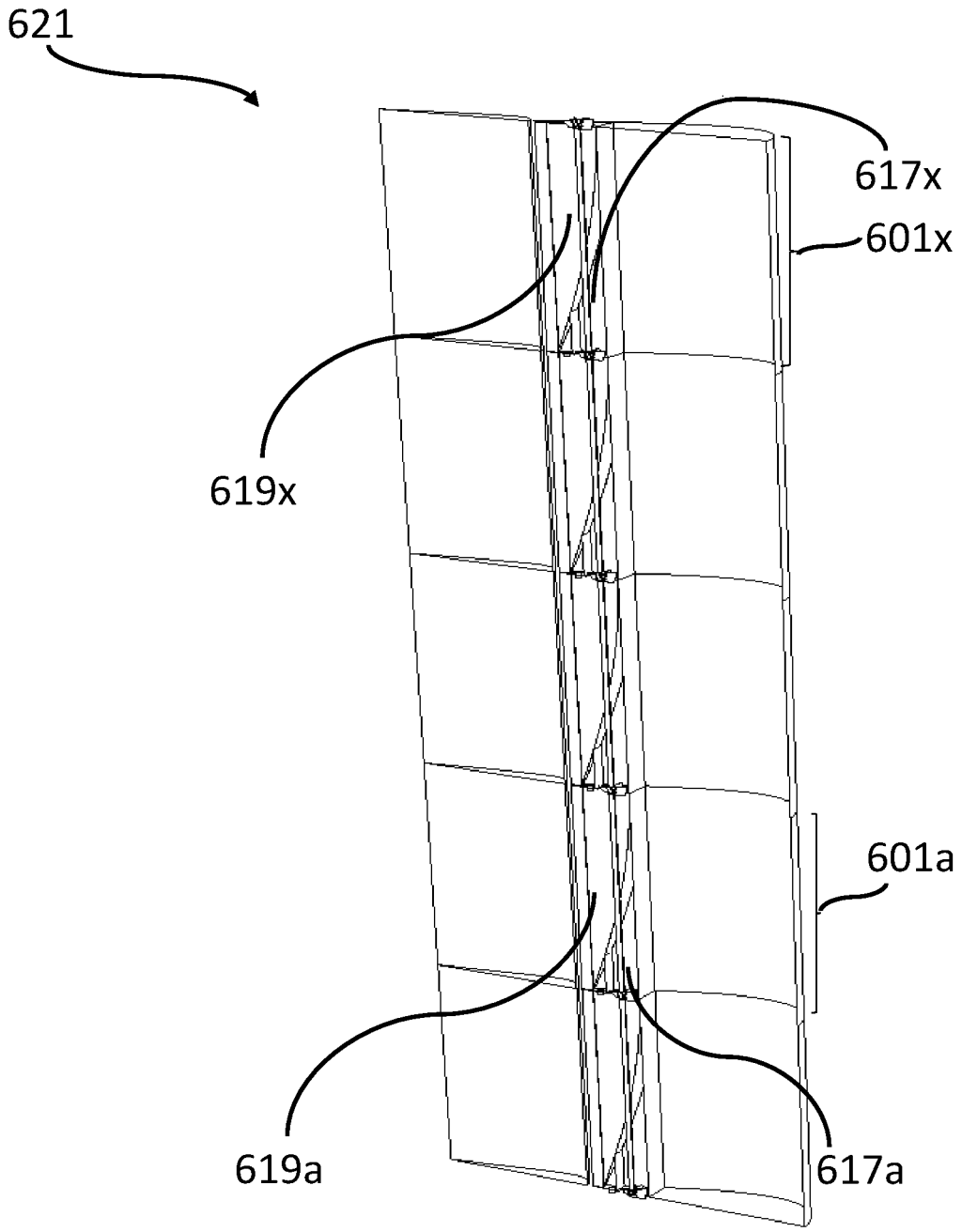
FIG. 12 shows a vertical cross-section of a modular wingsail.
Figure 13:
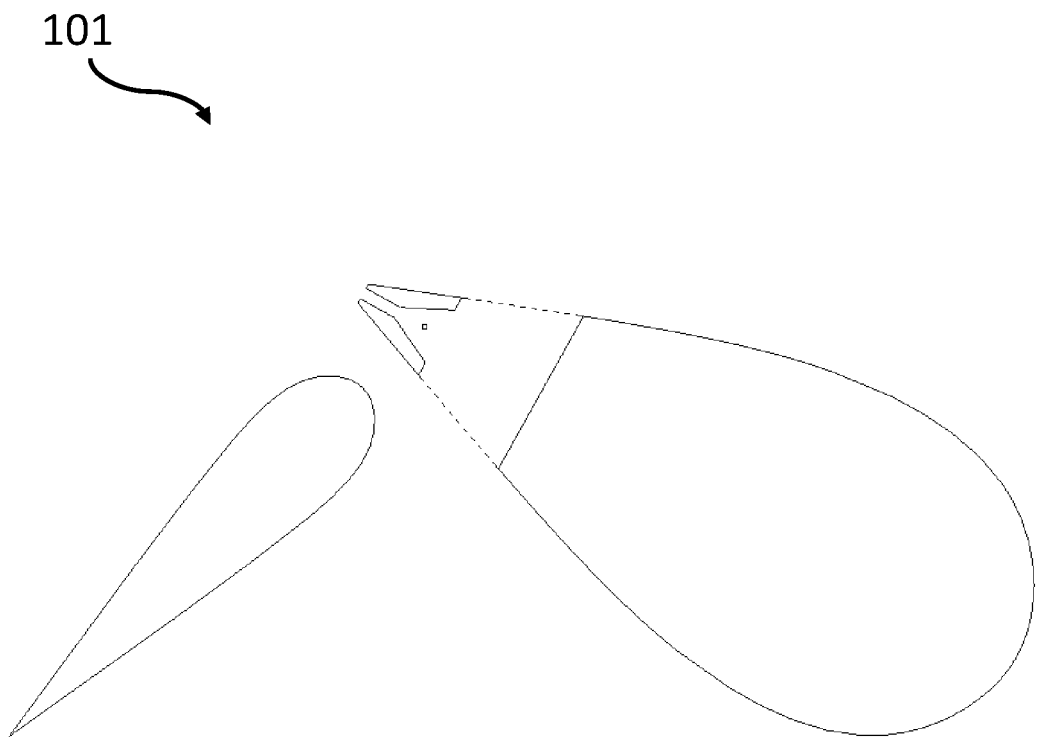
FIG. 13 shows a plan view of a wingsail in a cambered configuration.

FIG. 11 shows an external view of a wingsail 621 comprising wingsail modules 601*a* and 601*x*. Further modules may also be included as shown in FIG. 11, in some examples. FIG. 12 shows an internal cross section of wingsail 621 comprising wingsail modules 601*a* and 601*x*.

Wingsail 621 comprises at least two wingsail modules 601*a* and 601*x* each having an inlet 607*a* and 607*x* which are aligned with each other. Wingsail module 601*a* comprises an air vent 619*a*. Wingsail module 601*x* comprises an air vent 619*x*. In wingsail 621, an air vent for each wingsail module 601*a* and 601*x* (such as air vent 619*a* and 619*x*) guides internal air flow from a pressure flow generator to an air outlet for each wingsail module 601*a* and 601*x*. Each wingsail module (e.g., wingsail module 601*a* and 601*x*) may have its own pressure differential generator. An air vent for each wingsail module may guide internal air flow from an internal pressure differential generator to an air outlet.

Wingsail 621 may comprise at least one fan at the trailing edge of the front aerofoil (similar to aerofoil 103 in wingsail 101) of each wingsail module 601*a*, 601*x*, etc. Each fan may be driven by one or more hydraulic or electric motors. Each fan may be connected by a central shaft made by shaft modules for each wingsail module. In the example of FIG. 11, shaft module 617*a* of wingsail module 601*a* is connected to shaft module 617*x* of wingsail module 601*x*.

Wingsail module 601*x* is positioned at the top of wingsail 621. Wingsail module 601*a* is a wingsail module other than top wingsail module 601*x*. The channel of each module (e.g., channels 617*x* and 617*a*) are sloped so that each channel is longer along a vertical axis of each wingsail module 617*a* and 617*x* (where both axes are similar to axis 132 of wingsail 101) at an air outlet of each wingsail module than at an air inlet of each wingsail module 607*a* and 607*x*. As each wingsail module has this channel shape, air flow from the air inlet of a higher modular section through a pressure differential generator to the air outlet of a lower modular section. For example, air flow from air inlet 607*x* will be directed to an air outlet of a wingsail module directly below wingsail module 601*x*. Air flow from an air inlet of a wingsail module directly above wingsail module 601*a* will be directed towards an air outlet of wingsail module 601*a*. Air flow from air inlet 607*a* will be directed to an air outlet of a wingsail module directly below wingsail module 601*a*. As wingsail module 601*x* is at the top of wingsail 621, air flow is drawn in from above wingsail module 601*x* and directed towards an air outlet of wingsail module 601*x*.

As discussed above with relation to FIGS. 8, 9 and 10, other channel shapes may be used to provide different air flow between modules of a modular wingsail. For example, if the channel is sloped so that the channel is longer along a vertical axis of a wingsail module at an air inlet than at an air outlet, air flow will be directed from the air inlet of a lower modular section through a pressure differential generator to the air outlet of a higher modular section. In this case, the bottom wingsail module will draw in air from below the modular wingsail. Further, non-sloped (substantially straight, or straight, along a vertical axis of the wingsail module) channels may be used to direct air flow to an air inlet of a modular section through a pressure differential generator to the air outlet of a same modular section.

In another embodiment of the invention the wingsail may comprise an air inlet as shown in previous examples and an air outlet at the base or the tip of the wingsail. Wherein air is sucked into the air inlet by a fan positioned at the air outlet at the base or the tip of the wingsail and internal flow is directed either up or down the span of the wingsail.

The wingsail devices described herein may comprise one or more internal structure members. For example, a wingsail or wingsail module may comprise, for example, at least one: of a structural steel main spar; an aluminium main spar; a composite main spar. The wingsail may also comprise transverse and/or longitudinal stiffeners made of similar material. In such examples, an outer skin may produce the external aerodynamic shape of the device of the device and may comprise, for example, at least one of: steel; aluminum; composite. The internal air vents (channels) may comprise, for example, at least one of: steel; aluminum; composite.

In some examples, the device may have a monocoque structure having a thicker external skin comprised of, for example, at least one of: steel; aluminium; composite. This monocoque structure may take much of the structural loads of the device.

The device may rotate its angle of attack to the apparent wind using either a slew gear bearing or a bearing with rack and pinion system, wherein this bearing may be connected to the bottom section of the wingsail and connect the wingsail to its base (which is connected to the vessel). This bearing may be located beneath the first aerofoil 103 at a position where the wingsail 101 is able to naturally weather cock if all systems fail. In a natural weather cocked configuration the wingsail 101 will feather to the wind in a similar configuration as shown in FIG. 3.

In the above-described examples, only one air inlet (comprised of a starboard air inlet and corresponding port air inlet) in the front aerofoil is described. In further examples, devices may have multiple air inlets each comprising a starboard air inlet and a port air inlet in the front aerofoil.

In the above-described examples, only one air outlet in the front aerofoil is described. In further examples, devices may have multiple air outlets in the front aerofoil.

In further examples, a wingsail may comprise at least one air inlet in the second aerofoil. In further examples, a wingsail may comprise at least one air outlet in the second aerofoil.

Figure 14A:
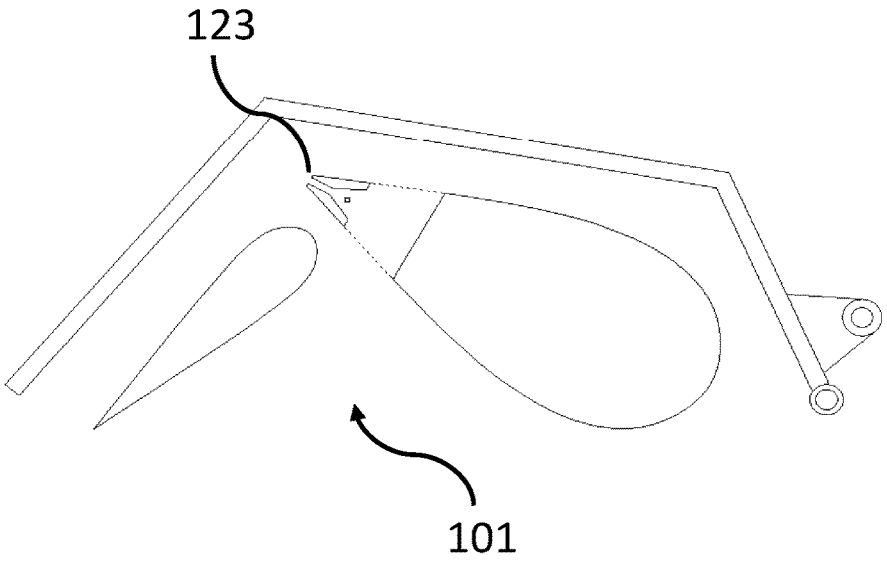
FIG. 14A shows a plan view of a wing sail in a stowed and protected configuration.
Figure 14B:
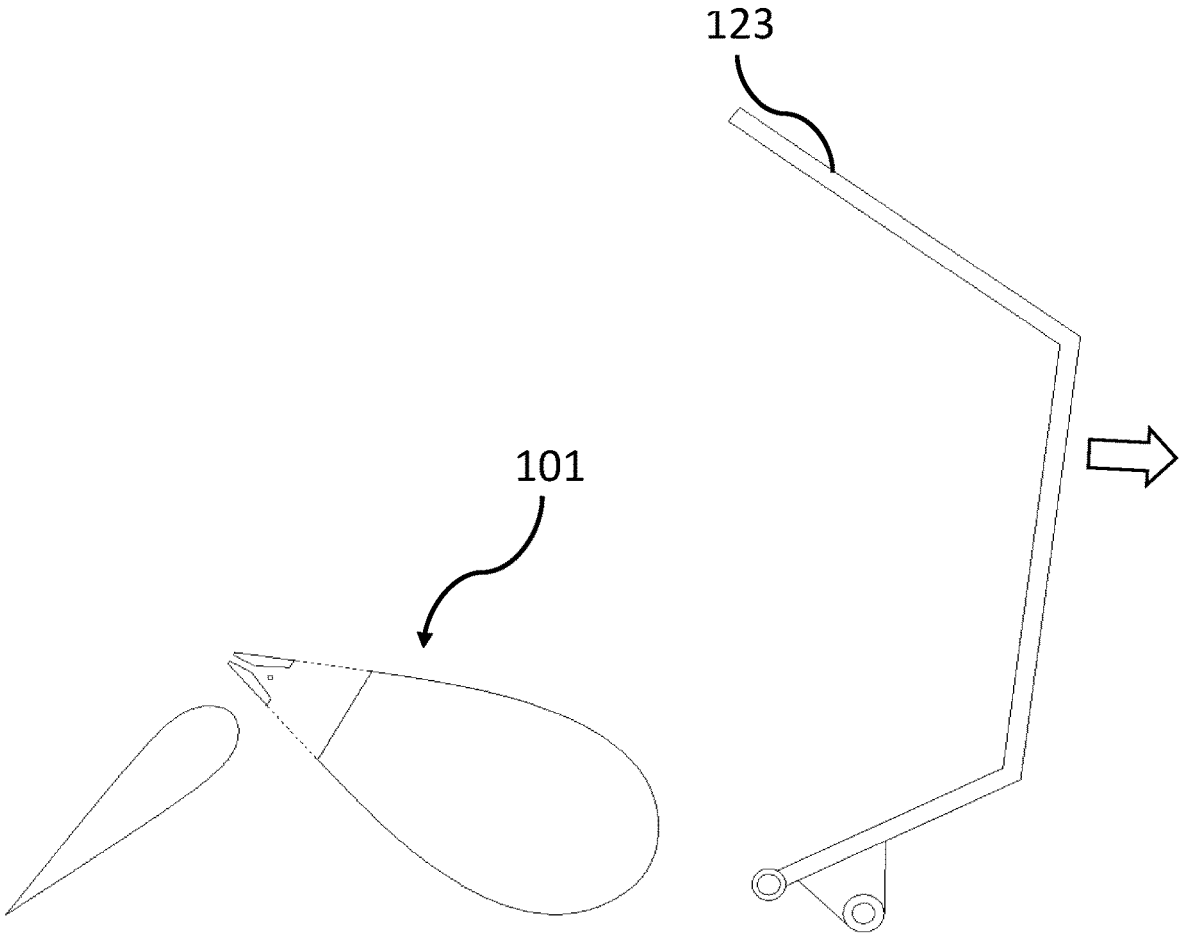
FIG. 14B shows a plan view of a wing sail in a stowed and non-protected configuration.

According to some examples, wingsail 101 may be stowed and protected by a protective covering 123. This process is shown in FIGS. 14A and 14B. In FIG. 14A, wingsail 101 is in a stowed configuration and protected by protective covering 123. In FIG. 14B, protective covering 123 is opened, allowing wingsail 101 to adjust to different orientations. Protective covering 123 may be comprised of steel or other material and this covering may be folded or rotated over the device to protect the device from crane grabs, falling material such as iron ore or other impact causing scenarios which may damage the wing.

According to some examples, a wingsail as described herein may comprise a base plate and an end plate. These plates may improve the aerodynamic performance of the device by reducing vortex shedding as a result of the generation of lift.

According to some examples, a wingsail as described herein may comprise a base plate and an end plate may comprise fences along the span of the device to help direct the flow across the surface of the device and reduce vortex shedding and associated losses.

A double element wingsail comprised of two aerofoils below is described further below with respect to FIGS. 15 to 26. A method for moving the two aerofoils relative to each other is described. It should be noted that aerofoils described with respect to FIGS. 15 to 26 below may have air inlets and air outlets to control air flow as described above. Any of the features described with respect to FIGS. 15 to 26 below may be incorporated into any of the above-described wingsails, such as wingsail 101, 401 and 623, for example.

Figure 15:
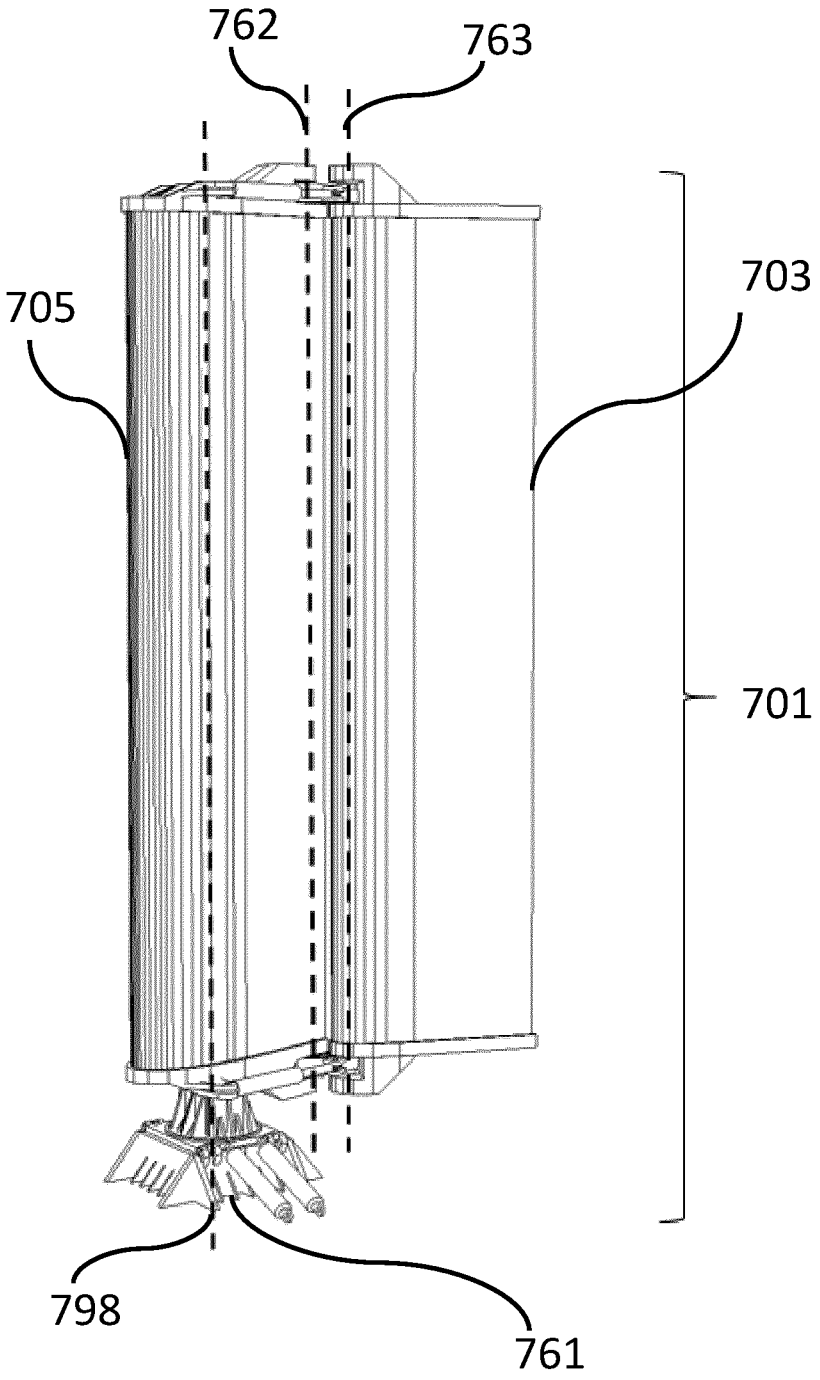
FIG. 15 shows a port-side view of a wingsail.
Figure 16:
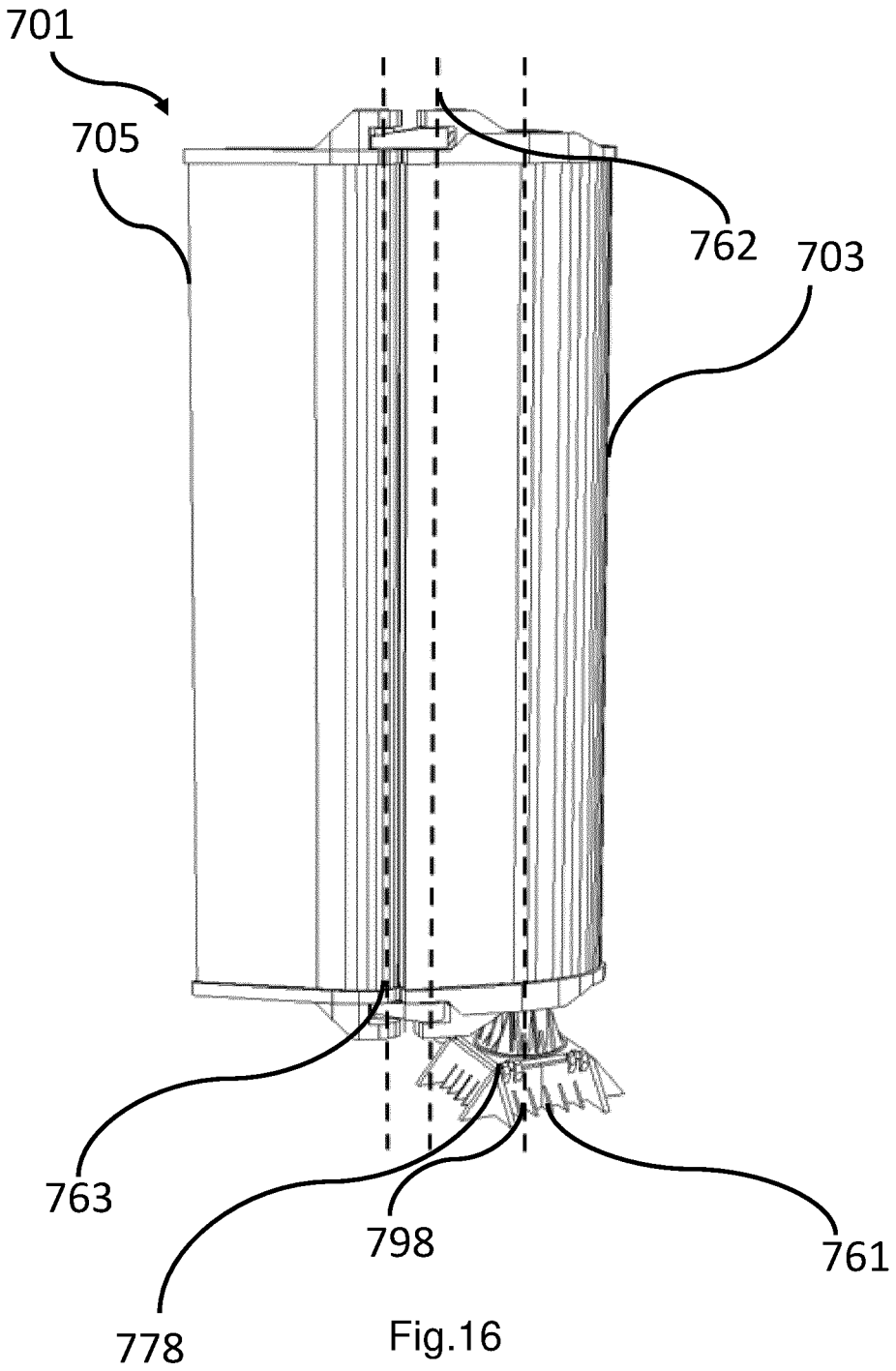
FIG. 16 shows a starboard-side view of a wingsail.
Figure 17:
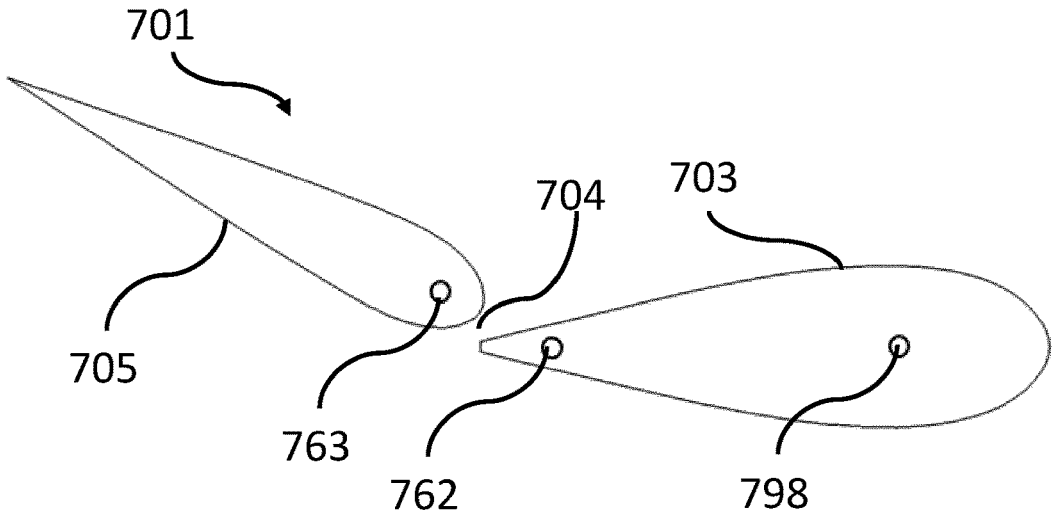
FIG. 17 shows a cross-section of the wingsail showing rotation points of a wingsail.

FIGS. 15 and 16 show a wingsail 1. FIG. 15 shows a port view and FIG. 16 shows a starboard view. Wingsail 701 is comprised of a first aerofoil element 703 and a second aerofoil element 705, the first aerofoil element 703 is the leading element and the second aerofoil element 705 is the trailing element. The second aerofoil element 705 is rotatable relative to the first aerofoil element 703 to form a cambered shape (as shown in FIG. 17) which is beneficial for producing a lift force. Between the first aerofoil element 703 and second aerofoil element 705, a 'slot' 704 is formed when the second aerofoil element 705 is rotated in relation to the first aerofoil element 703, and this slot 704 allows high energy flow from the pressure side to flow to the suction side and allows the flow to stay attached at a higher angle of attack-which is beneficial for producing lift. The second aerofoil element 7053 may be of the same chord length as the first aerofoil element 703 but in some cases may be shorter or longer. The thickness of the first aerofoil element 703 may be thicker than the second aerofoil element 705 to increase the second moment of area of the internal structure and to optimise the aerodynamic performance of the device. The shape of the aerofoil section comprising the first aerofoil element 703 and second aerofoil element 703 has a maximum thickness within the leading half of the section. The curvature of each aerofoil section comprising aerofoil elements 703 and 705 is convex along the total length of each section, the curvature remains positive along the total length and does not include any inflections.

The first aerofoil element 703 is connected directly to base 706 of wingsail 701. Base 706 connects wingsail 701 to an associated marine vessel. Second aerofoil element 705 is connected to base 706 of wingsail 701 via a connection to first aerofoil element 705.

Figure 18:
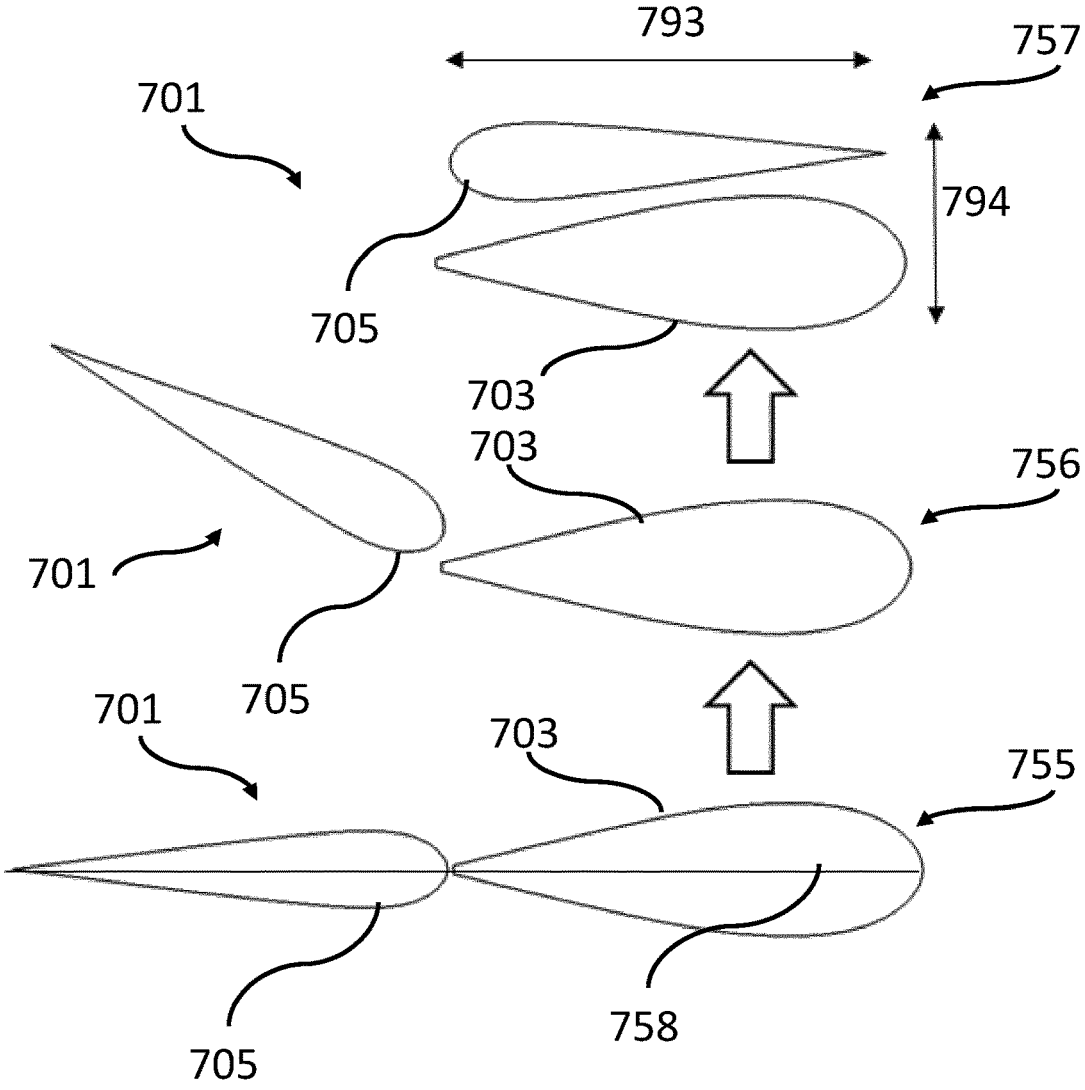
FIG. 18 shows cross-sections of three configurations of a wingsail.

FIG. 18 shows some example different configurations of wingsail 701. Wingsail 701 as shown in FIG. 18 is capable of transitioning between a feathered configuration 755 in which the cross-sectional centreline 758 of both aerofoil elements 703 and 705 are aligned, to a cambered configuration 756 in which the second aerofoil element 705 rotates in relation to the first aerofoil element 702. The wingsail 701 is also capable of articulating to a configuration where the first aerofoil element 703 and second aerofoil element 705 form a tightly packed configuration 757.

Figure 19:
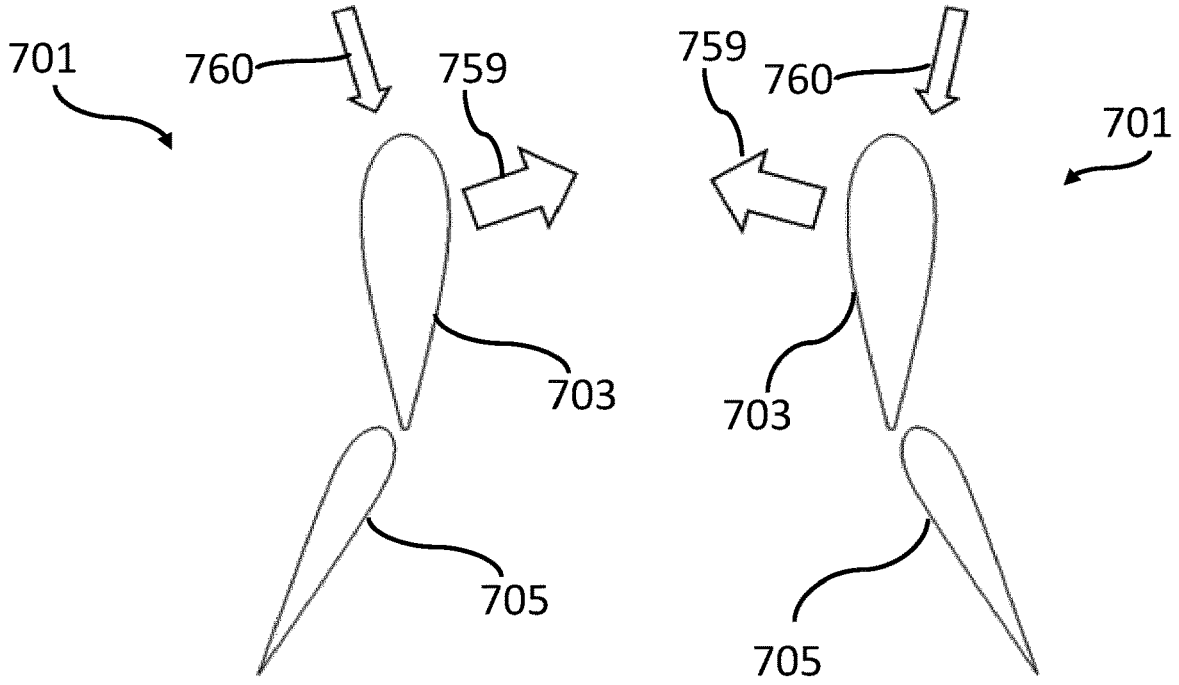
FIG. 19 shows cross sections of the a port tack and a starboard tack of a wingsail.

Wingsail 701 can invert its camber in both directions to allow the wingsail to produce lift 759 with the wind angle 760 coming from both its right and left side, as shown in FIG. 19. Wingsail 701 is also able to rotate 360 degrees around its base 706 about an angle of attack axis 748 to allow an angle of attack of wingsail 701 to be adjusted and optimised to the direction of the wind in relation to the marine vessel. By adjusting both the angle of attack of wingsail 701 and a camber of wingsail 701, the aerodynamic flow around wingsail 701 can be optimised to produce a desired amount of thrust force.

To allow wingsail 701 to be stowed while producing minimal interference during port operations, wingsail 701 can minimise its stowed height above a deck of the marine vessel and ensure the first aerofoil element 703 and second aerofoil element 705 are not protruding in any way. To do this wingsail 701 forms a tightly packed configuration as presented in configuration 757 of FIG. 18 and folds from a vertical position to a horizontal position to minimise an overall height of wingsail 701. This process is described in the following paragraphs.

To allow wingsail 701 to both adjust its camber and fold into the tightly packed configuration as shown in configuration 757 of FIG. 18, the second aerofoil element 705 can be rotatable relative to the first aerofoil element 703 about at least one vertical axis. According to some examples, the at least one vertical axis comprises two vertical axes. At least one linear actuator (preferably a hydraulic ram) may connect to the first and second aerofoil element.

According to some examples, the primary axis 762 for rotation of the second aerofoil element 705 relative to the first aerofoil element 703 may be located within the first aerofoil element 703 and the secondary axis 763 for rotation of the second aerofoil element 705 relative to the first aerofoil element 703 may be located within the second aerofoil element 705. An axis 798 may be provided for the rotation of the first aerofoil element 703 relative to the base of the wingsail. To connect the first aerofoil element 703 and the second aerofoil element 705 and create two rotational axis the two aerofoil elements may be connected by a middle linking member 771. Middle linking member 771 may house spherical or roller bearings, or other forms of mechanical bearings or rotating joints to freely connect the linking member to first aerofoil element 702 and second aerofoil element 705. Linking member 770 may comprise a top bar 772 and a bottom bar 773, and the top bar 772 and bottom bar 773 may be connected by a torsional structural member 774 to align the top and bottom bar and resist any torsional moments between the tip and the base of the wing. The torsional structural member 774 may comprise a torsional spar and may be spherical and comprised of steel, aluminium, or composite. A bottom linear actuator 765 at the base of the wing (preferably a hydraulic ram) connects to both the linking member 771 (preferably to the bottom bar 773) and to the structure of the first aerofoil element 703, preferably to a first element base structure 784 and controls the relative movement of both parts. In a similar manner the wingsail 701 may comprise a top linear actuator 764 (preferably hydraulic ram) connecting the top bar 772 of linking member 771 with the structure of the first aerofoil element 703 and may connect to the first element end structure 783. The connection of linear actuators 764 and 765 to wingsail 701 may attach to pins fixed between two brackets fixed to each part of the wingsail 701 and allow the attachments to freely rotate with the changing angles. Top linear actuator 764 and a bottom linear actuator 765 are preferably used to drive the rotation of the linking member 771 in relation to the first aerofoil element 703. The connection points between the rams 764 and 765 and the linking member 771 may be on both the top bar and bottom bar, and its connection preferably is able to rotate relative to the linking member 771. The linking member may comprise, in addition to top bar 772 and bottom bar 773, other connecting bars spaced in between these two bars which may also be fixed to the torsional structure. These connecting bars may also comprise rotational bearings which connect first aerofoil element 703 to the second aerofoil element 705 and allow rotation between one another by way of two vertical axis. The primary axis 762 is a vertical axis preferably within the first aerofoil element 703 and runs through the centre of each of the bearings connecting the first aerofoil element 703 to the linking member 771. The secondary axis 763 is a vertical axis preferably within the second aerofoil element 705 and runs through the centre of each of the bearings connecting the second aerofoil element 705 to the linking member 771.

Figure 20:
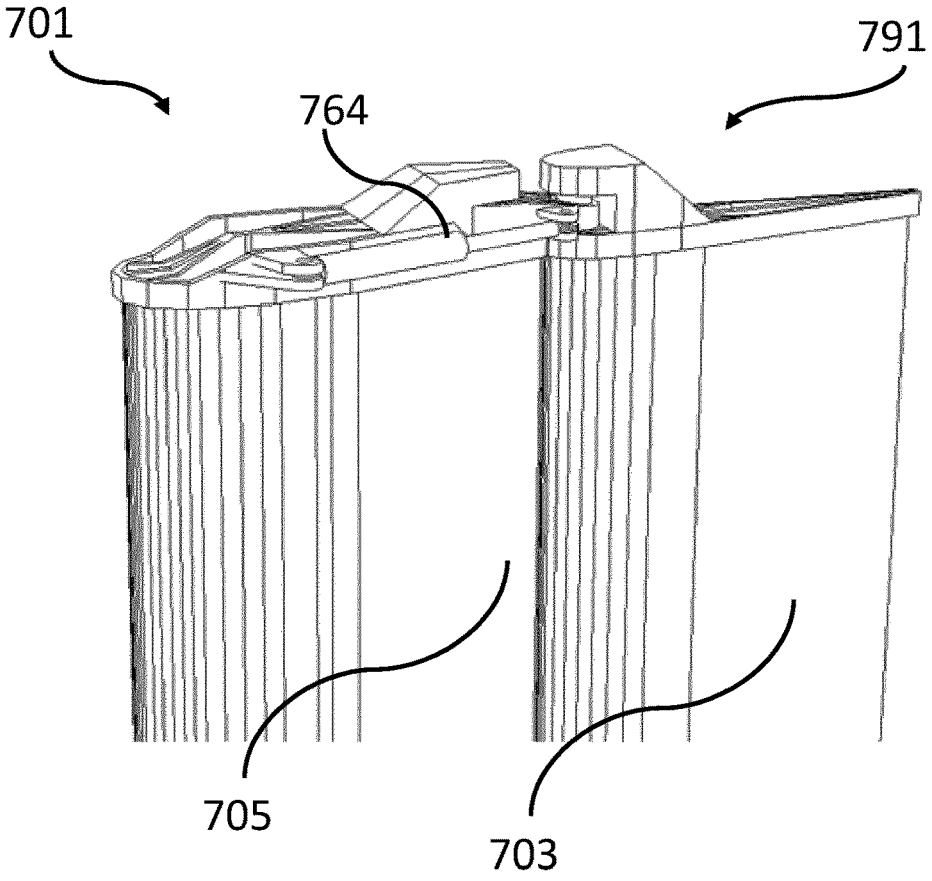
FIG. 20 shows a magnified portion of the top of a wingsail.
Figure 21:
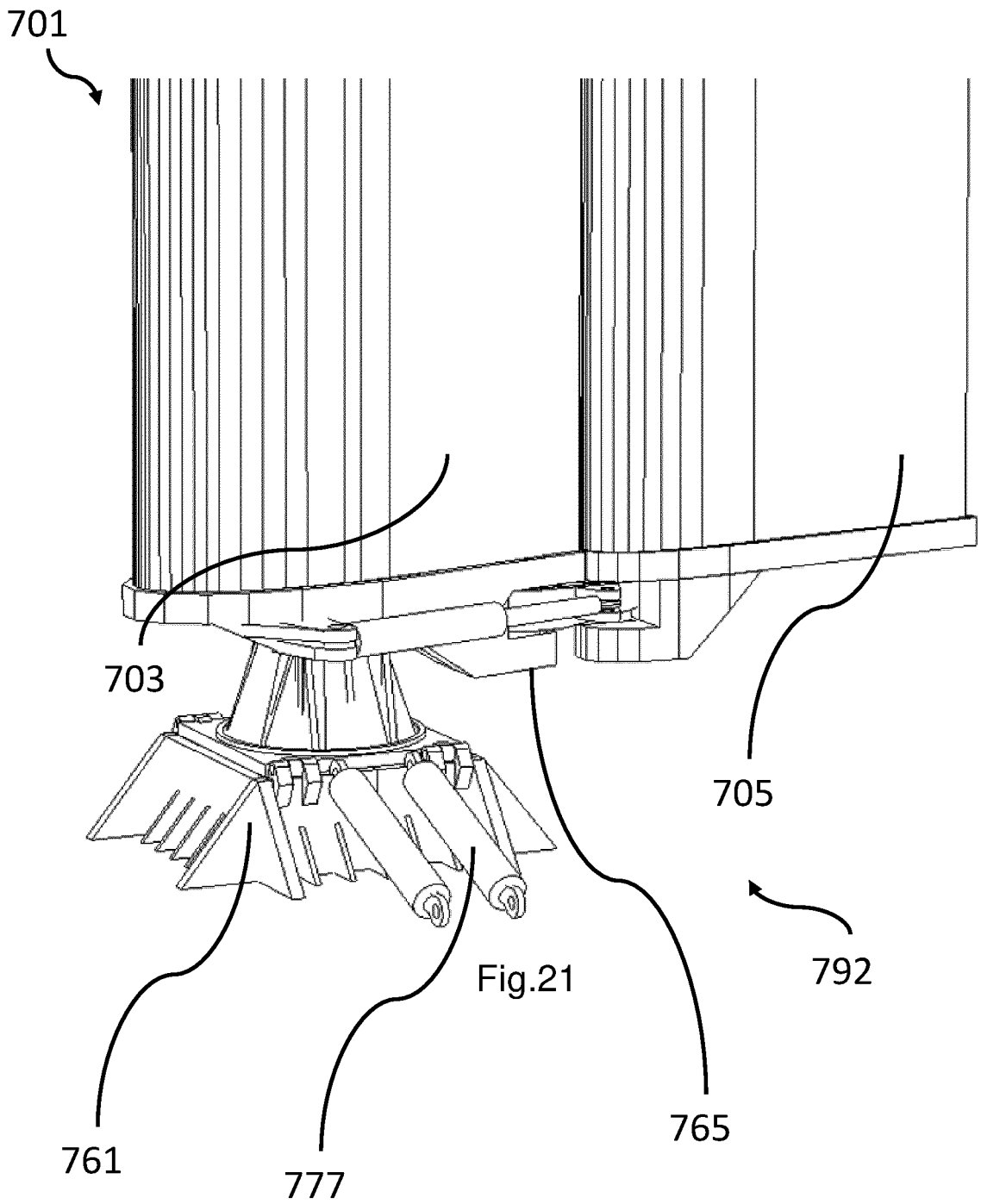
FIG. 21 shows a magnified portion of the base of a wingsail.
Figure 22:
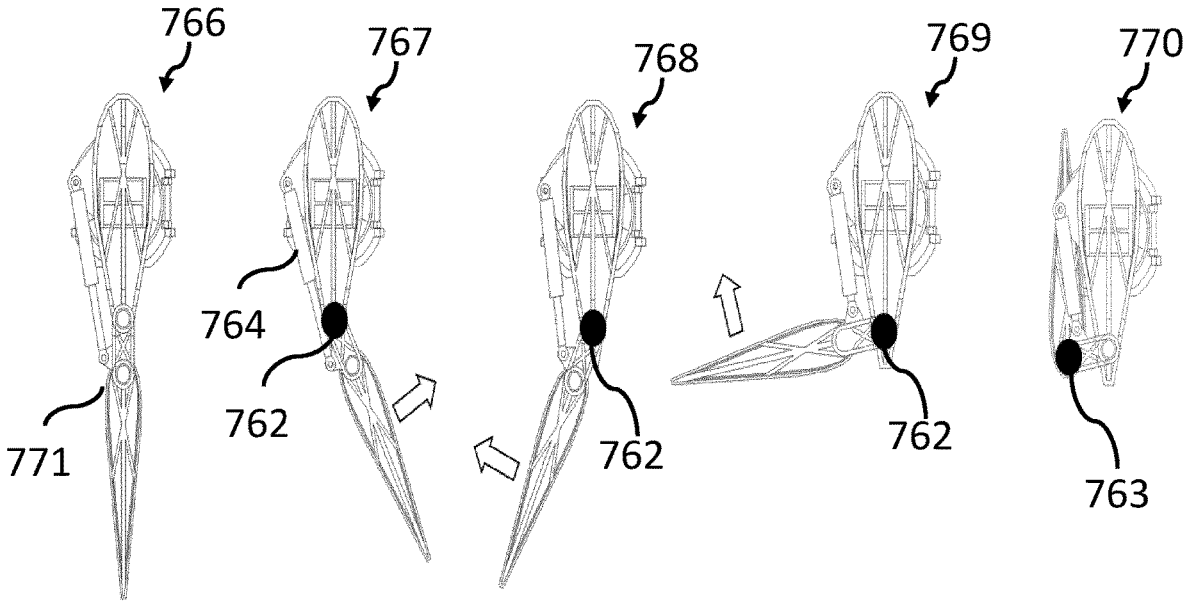
FIG. 22 shows five configurations of a wingsail.
Figure 23:
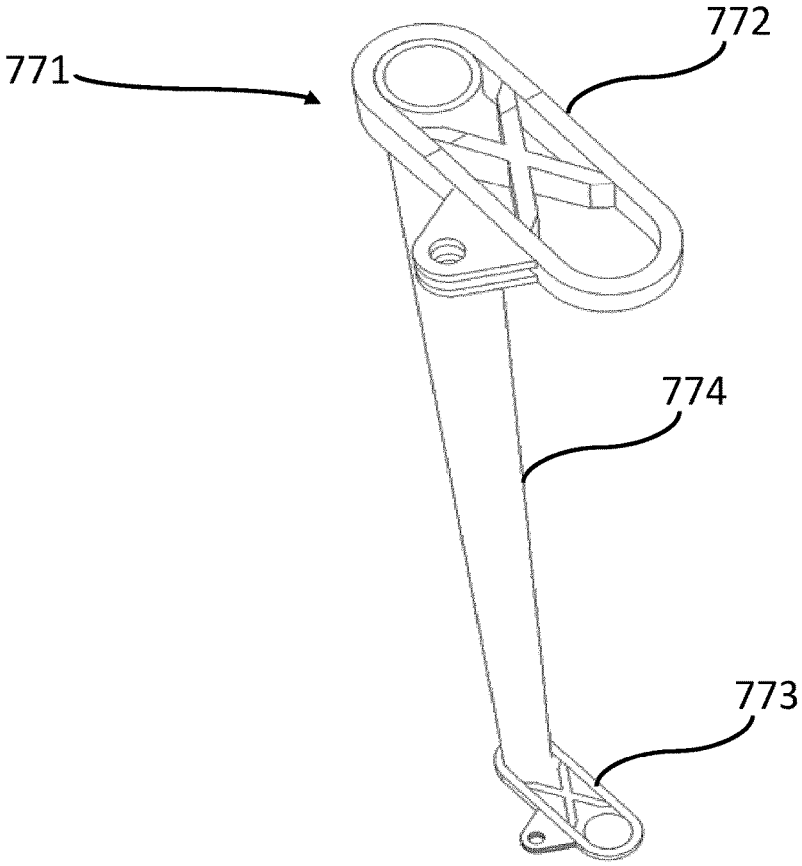
FIG. 23 shows a linking member of a wingsail, the linking member used to connect leading and trailing elements of a wingsail.

The full range of motion of wingsail 701 according to some examples is presented in FIG. 22. To adjust and invert the camber of wingsail 701 the second aerofoil element is rotated about the primary axis 762 to complete the range of motion required to actively trim the wing to optimise the aerodynamic flow. This movement may be controlled by one or more linear actuators, preferably one top linear actuator 764 at a top 791 of wingsail 701 and one bottom linear actuator 765 at the bottom 792 of wingsail 701 as shown in FIGS. 20 and 21. As depicted in FIG. 22, configuration 766 shows the neutral 'feathered' configuration, configuration 767 shows maximum working camber to starboard (typically in the range of 10-25 degrees from centre) and configuration 768 shows maximum working camber to port (typically in the same range as maximum working camber to starboard 767).

To fold the wingsail 701 into its stowed configuration the second aerofoil element 705 is rotated around its primary axis 762 to a maximum rotational position. The maximum rotational position may in some examples be where the minimum stroke of a ram (or another linear actuator) is reached. This is shown as configuration 769. The second aerofoil element 705 then rotates in relation to the first aerofoil element 705 2 about its secondary axis 763 by way of approximately 90 degrees to create a tightly packed configuration 770. This tightly packed configuration 770 preferably minimises the combined length 793 and thickness 794 of both the first aerofoil element 703 and second aerofoil element 705 and results in an orientation of the second aerofoil element 705 in relation to the first aerofoil element 703 which is reversed from its feathered configuration 766. The centreline of the first aerofoil element 703 and second aerofoil element 705 may sit in parallel in this configuration or up to approximately 40° and the second aerofoil element 705 preferably sits within the length of the first aerofoil element 703. This rotation around the secondary axis 763 may be controlled either by rotary actuator or secondary ram arrangement connected between the linking member 771 and the second aerofoil element 705 and preferably be a hydraulic linear ram or hydraulic rotary actuator. In the case of a hydraulic linear ram being used this forms a double ram arrangement in series which allows the second aerofoil element 705 to rotate in relation to first aerofoil element 703 by an angle greater than 180 degrees. The same angle is achieved if a rotary actuator is used.

Figure 24:
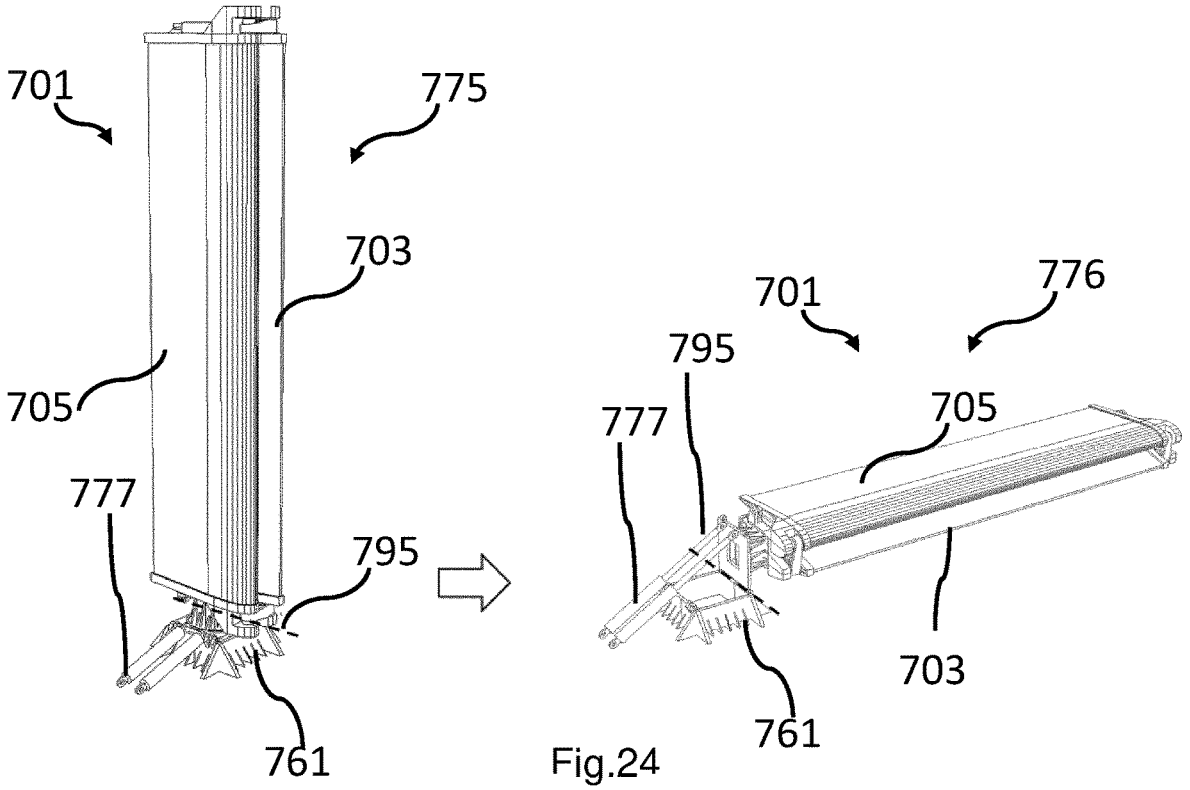
FIG. 24 shows an upright configuration and a stowed configuration of a wingsail.

When the second aerofoil element 705 folding articulation routine is complete (as described above and in FIG. 22), wingsail 701 is ready to be folded down to deck to prepare for port operations. FIG. 24 shows this process. The base 706 of wingsail 701 is connected to a pivotable plate 778 which is connected to the base structure 706, preferably a steel fabricated structure of welded plates and flanges, by way of a hinged arrangement. This arrangement allows wingsail 701 to rotate about a horizontal axis 795 to transition between an upright condensed configuration 775 (upright) and a stowed configuration 776 (horizontal). Hydraulic cabling and other low voltage electronic cabling may be passed from inside the base 761 through an opening in pivotable plate 778 and up into wingsail 701.

Wingsail 701 in its upright condensed configuration 775 is lowered to its stowed configuration 776 by two linear actuators, preferably hydraulic rams 777, which take the load of the weight of the wingsail 701 as tension. One single ram is capable of raising and lowering the wingsail 701 and the second of these two rams reduces the load in one single ram and provides redundancy in the system in case of failure of one of the rams or its systems. The same process is repeated in reverse to transfer wingsail 701 from its stowed configuration to its upright and working configuration.

In its stowed configuration wingsail 701 sits horizontally and ideally sits parallel to the deck of the vessel. The tip of wingsail 701 is supported by a deck support and a locking pin fixes this in place. On a bulk carrier vessel, the wing base will preferably be fitted on the side deck between hatch cover slides and will be lowered to a stowed configuration above hatch covers. The hatch covers will be able to slide underneath the stowed wingsail 701 to allow port operations to be uninterrupted. Wingsail 701 will preferably sit at least two metres above the deck to allow for passageway underneath. For bulk carrier installations and other installations where deck space is restricted the rams may be fitted to the underside of the pivotable plate 778 and sit in a cavity within the deck. Where deck space is not restricted the rams will be positioned above the deck as shown in FIG. 24.

Figure 25:
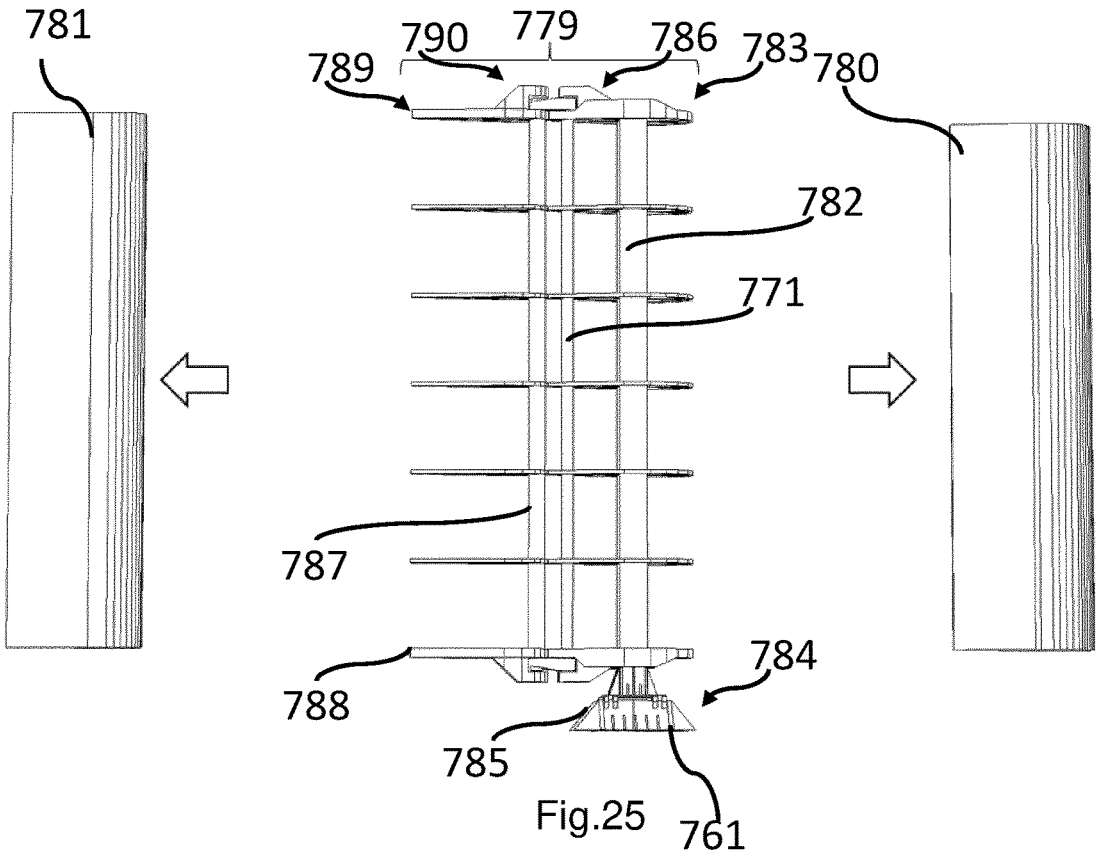
FIG. 25 shows a wingsail with aerodynamic fairings removed.

The construction of wingsail 701 according to some examples is simple and robust and its simplicity minimises the total cost of the wingsail 701 allowing the fuel saved as a result of the wing to 'pay back' the wing in a shorter time period. FIG. 25 shows the bare structure 779 of the wingsail 701 and the first aerofoil element fairing 780 and second aerofoil element fairing 781 removed for clarity. The main structure may comprise a main spar 782 which may be connected to a first element base structure 784 and first element end structure 783 and may also be connected to a number of structural ribs 797 to provide support to the first aerofoil aerodynamic fairing 780. In another embodiment of the invention the structure may not include structural ribs 797. The main spar 782 protrudes beneath the first aerofoil element 703 and first element base structure 784 and attaches to the top of a bearing arrangement 785, preferably a hydraulic driven slew gear bearing, which allows wingsail 701 to rotate about 360 degrees relative to the base and the vessel. The loads are transferred and spread out evenly to the bearing to minimise localised stress concentrations which may impinge the rotation of the device. These loads may be spread out and transferred though triangular flanges preferably welded to the main spar 782 and a plate which is subsequently bolted to the top of the bearing arrangement. These triangular flanges may be comprised of steel plate. Other methods for transferring loads from the main spar 782 and the bearing may be used.

According to some examples, the underside of the bearing arrangement 785 is bolted to the pivotable plate 778 which is preferably a steel plate with structural reinforcement flanges. Pivotable plate 778 is connected to the wingsail base 761 by way of a hinged arrangement with a horizontal axis 795 along one edge of the pivotable plate 778, and by a locking pin arrangement on the other edge of the pivotable plate 778. The base 761 is preferably comprised of a steel fabricated structure of welded steel plate and welded steel flange sections to transmit the forces and moments from wingsail 701 to the deck and ships existing and modified structure. The base 761 is preferably bolted or welded to the deck and loads transferred to the underlying structure.

According to some examples, the first element base structure 784, first element end structure 783 and structural ribs 797 may be comprised preferably of fabricated steel plate sections welded together to form a support for the first element fairing 780. These may also be comprised of aluminium or composite. The first element fairing is connected to the base support structure 34 and end support structure 783. This fairing may be joined by mechanical fastenings or chemically bonded. The first aerofoil aerodynamic fairing 780 and second aerofoil element aerodynamic fairing 781 may preferably be comprised of composite but may be comprised of steel or aluminium curved plate.

The main spar 782 may be comprised of steel fabricated box section or I-beam section or other construction methods to provide a structurally efficient shape in bending and torsion. The main spar 782 must transfer the total accumulation of loads generated by wingsail 701 to the base of the wing.

The first aerofoil element 703 may be connected to a linking member 771 which is rotatable relative to the first aerofoil element 703 about the primary axis 762. The first aerofoil element 703 may comprise a minimum of two bearings to connect it to the linking member 771 which is able to rotate. Preferably the first aerofoil element may comprise a double shear plane arrangement 786, 790 as depicted in FIG. 25.

FIG. 25 presents a structural view of wingsail 701 with linking member 771 highlighted to indicate how linking member 771 fits within the remainder of the wingsail structure. FIG. 25 also presents a scaled-up view of the first element base structure 784, second element base structure 788 and linking member 771 to depict how these parts link and rotate together and form the double shear pin arrangement. Although the following detail is described for the base of the wing the mechanism is assumed to be similar for the end of the wing and may be found in any other location along the primary axis 762.

Figure 26:
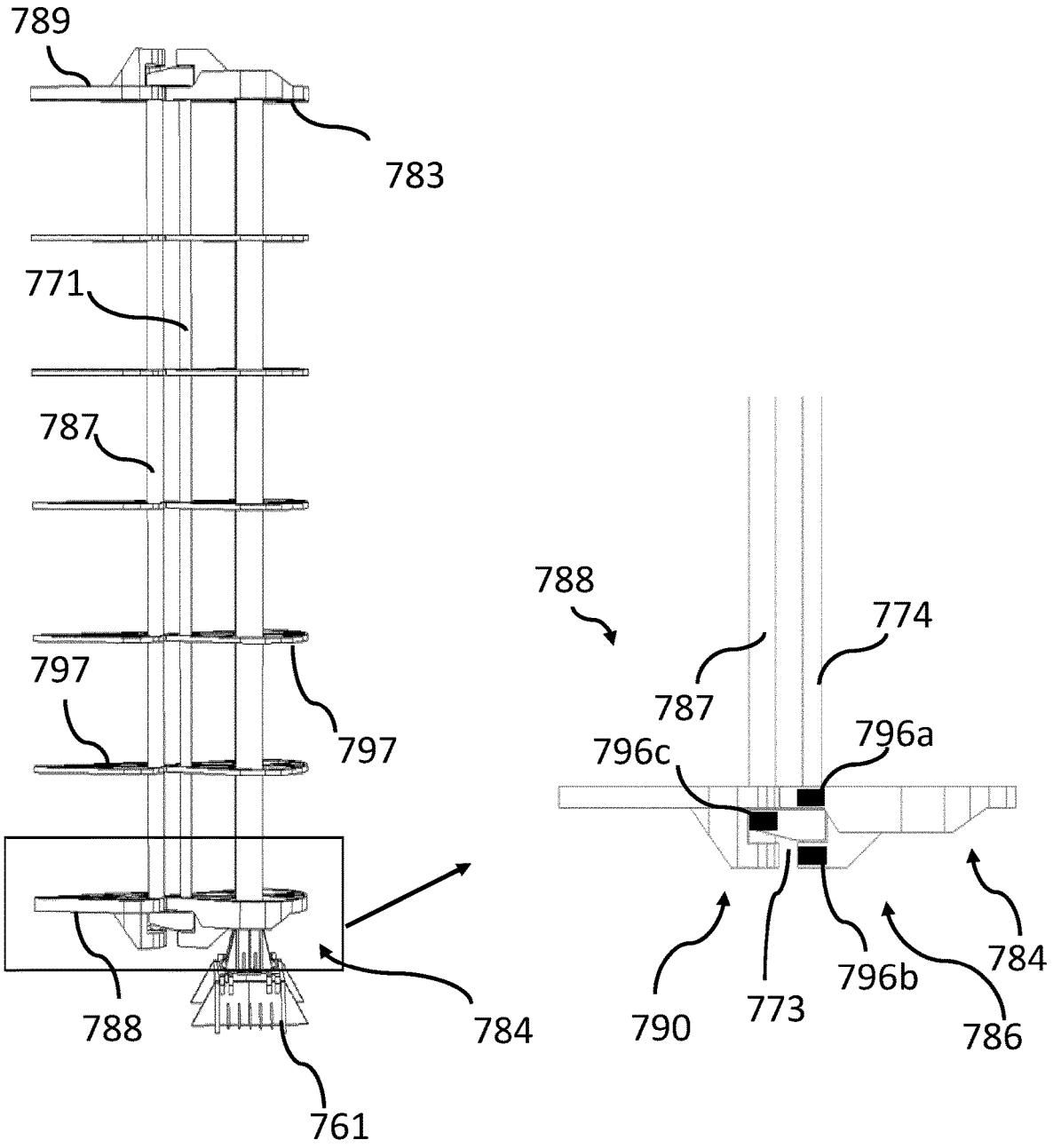
FIG. 26 shows wingsail with aerodynamic fairings removed.

According to some examples, the first element structure (which may be comprised of first element base structure 784, first element end structure 783 and structural ribs 797) may house a minimum of two bearings but preferably comprise more than two bearings. FIG. 26 provides an example of a double bearing assembly embedded into the first element base structure although this assembly may be found at any point within the structure of the first aerofoil element 703 along the primary axis 762, and in this example is repeated within the first element end structure 783 but not shown in detail.

The bearing assembly depicted in FIG. 26 may comprise top bearing 796*a* and bottom bearing 766*b* and these bearings may be spaced apart with an opening between each to house the bottom bar 773. The top bearing 766*a* and bottom bearing 766*b* can be mechanically connected or bonded to the linking members torsional structural member 774 to allow rotation of the linking member 771 in relation to the first element base structure 784. The use of two bearings 796*a* and 796*b* creates a double shear plane arrangement which provides the joint with greater stability and restricts the linking member 771 from rotating transversely in relation to the first element base structure 784. A bearing 796*c* may also be provided for rotation of the second aerofoil element relative to linking member 771. In another embodiment of the invention a single bearing is used to connect the linking member 771 to the first element base structure 784. If a single bearing is used the bearing may be a self-aligning bearing and be able to rotate with an off axis shaft, i.e. when the top of the wingsail 701 deflects and rotates at a greater angle than the bottom of the wingsail 701 due to the deflection under load of the wingsails structure, the bearing is able to self-align to maintain movement between the linking member 771 and the first element base structure 784 about the primary axis 762.

Bearings 796*a* and 796*b* may be cylindrical or self-aligning and must allow the linking member to freely rotate about the primary axis 762 whilst providing support for the load of the second aerofoil element 705. These bearings may transfer all the load from the linking member 771 to the first element base structure 784 and first element end structure 783, including the self-weight of the linking member 771 and second aerofoil element 705. Bearings may also be housed within structural ribs 797 or any other structure within the first aerofoil element 703. Adversely the structural ribs may contain space along the primary axis 762 to allow the torsional spar 774 of the linking member 771 to rotate freely without contact with structural ribs 797.

The linking member 771 rotates in relation to first aerofoil element 703 and may be connected to the second aerofoil element 705 via a bearing arrangement housed within the structure of the second aerofoil element 705 acting along the secondary axis 763. This bearing arrangement may be connected to a torsional structural member 787 which connects the top and base of the second aerofoil element 705 to withstand torsional forces and moments acting between the top and the base of the second aerofoil element 705 and ensures that the aerofoil element does not twist adversely.

The connection of linking member 771 to second aerofoil element 705 may be via two or more bearings fixed to torsional structural member 787 which may be fixed to a second element base structure 788 and second element end structure 789. This bearing arrangement allows the second aerofoil element 705 to be rotatable relative to the linking member about the secondary axis 763. This torsional structural member 787 withstands torsional forces and moments between the top and bottom of the second aerofoil element 705 and minimises deflection of the top portion of this element in relation to the bottom. This provides structural rigidity and avoids damage through excessive bending of the aerofoil element.

In a similar manner to the first aerofoil element aerodynamic fairings 780, the second aerofoil element aerodynamic fairings 781 may connect to the structure of the second aerofoil element 705. The second element aerodynamic fairings 781 may connect to the structure of the second aerofoil element 705 by mechanical fixing or bonding to the second element base structure 788, second element end structure 789 and structural ribs 797 of the second aerofoil element 705, or connection to any combination of these parts. These connections preferably comprise mechanical fastenings or bonding and the second aerofoil element fairing 781 is preferably comprised of composite but may be comprised of steel or aluminium plate.

The first aerofoil element fairing 780 and second element faring 781 may preferably be constructed in two half sections and bonded or mechanically fastened together or may be comprised of smaller plates bonded or mechanically fastened to the structural ribs 797 or made of smaller half sections. The structure of the second aerofoil element 705 may be comprised of steel fabricated plates or may be comprised of composite or aluminium.

All metallic structures of wingsail 701 may be painted with anti-corrosive paint to reduce corrosion during use within highly corrosive salty environments.

The base and end support structure for the first and second aerofoil elements (783, 784, 788 and 789) may comprise a base and end plate, fitted to improve the aerodynamic performance of the device by reducing vortex shedding as a result of the generation of lift.

Figure 27:
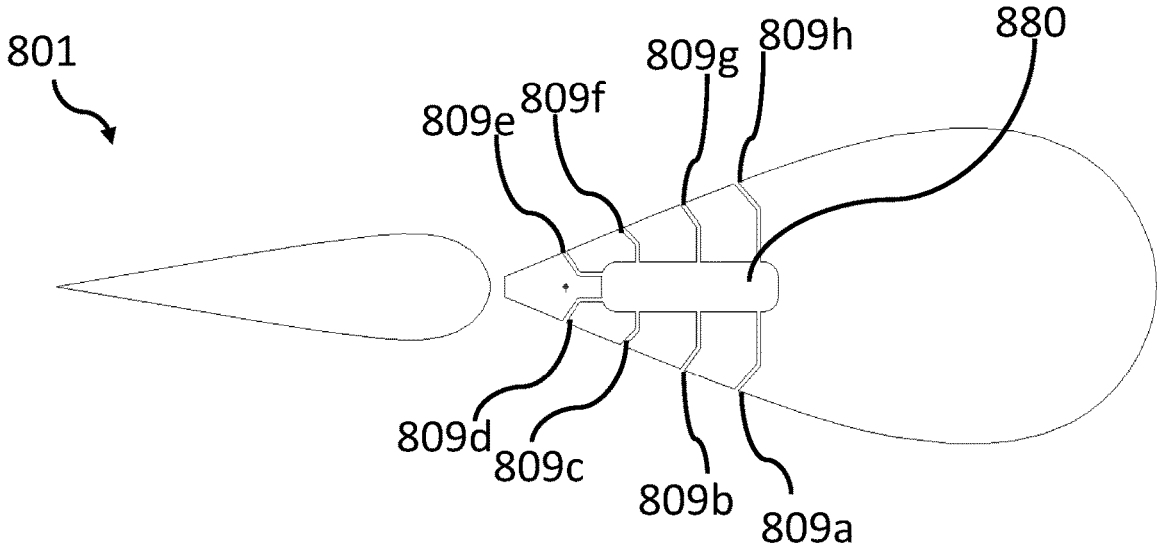
FIG. 27 shows a wingsail having multiple outlets in a front aerofoil.

FIG. 27 shows a cross section of an example wingsail 801 comprising multiple outlets 809*a*, 809*b*, 809*c*, 809*d*, 809*e*, 809*f*, 809*g*, and 809*h* in the leading (front) aerofoil. Wingsail 801 may operate similarly to wingsail 101, although instead of a single outlet (outlet 109 in aerofoil 103) wingsail 801 has multiple outlets in the front aerofoil. Wingsail 801 may comprise a pressurized cavity 880.

The multiple outlets 809*a*, 809*b*, 809*c*, 809*d*, 809*e*, 809*f*, 809*g*, and 809*h* may be provided at a particular height of wingsail 801, for example at the base of wingsail 801 or at the top of wingsail 801. In some examples, the outlets are positioned at regular intervals between the base of the wingsail 801 and the top of the wingsail 801. Wingsail 801 may also comprise one or more inlets in the front aerofoil (not shown in FIG. 27 for clarity). In some examples, the one or more inlets may be at a different height to the outlets. The multiple air outlets 809*a*, 809*b*, 809*c*, 809*d*, 809*e*, 809*f*, 809*g*, and 809*h* can act in a similar way to the single air outlet 109 of wingsail 101 in that the multiple outlets provide a high energy stream of air onto the surface of the wing to re-energise the boundary layer thus increasing the angle of attack of the wingsail 801 achievable before stall and also increasing achievable lift coefficient of wingsail 801. The multiple air outlets 809*a*, 809*b*, 809*c*, 809*d*, 809*e*, 809*f*, 809*g*, and 809*h* shall be configured so that air flow is directed to the high-pressure side and not the low-pressure side of the aerofoil by closing the low-pressure side air outlets. In some examples, the air outlets on the first aerofoil element shown in FIG. 27 will be situated towards the back half of the aerofoil element towards the trailing edge. In another example, one or more of these air outlets may be situated in the front half of the leading (front) aerofoil element.

Wingsail 801 may in some examples comprise a wingsail "unit" that can be repeated to provide a modular wingsail such as wingsail 621.

Although 8 outlets are shown in the leading aerofoil of wingsail 801, it will be understood that in other examples more or fewer outlets may be used.

Figure 28:
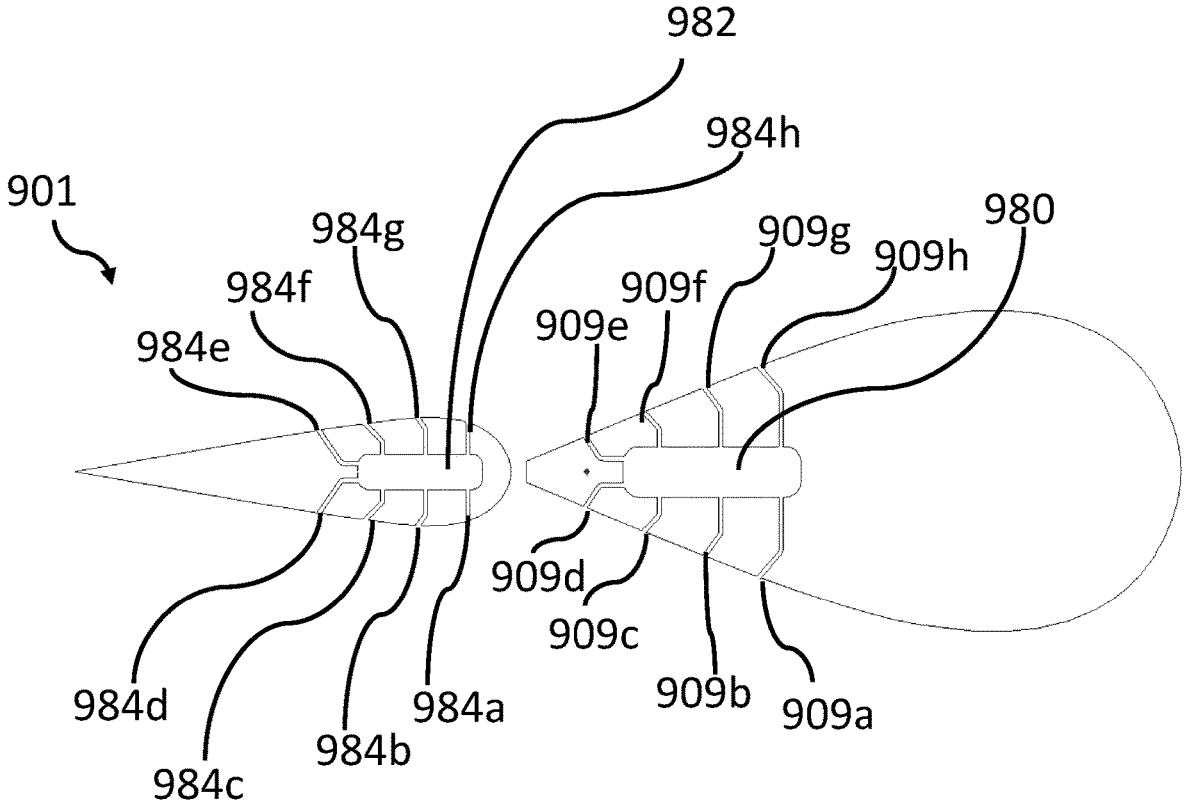
FIG. 28 shows a wingsail having multiple outlets in a front aerofoil and a rear aerofoil.

FIG. 28 shows a cross section of an example wingsail 901 comprising multiple outlets 909*a*, 909*b*, 909*c*, 909*d*, 809*e*, 909*f*, 909*g*, and 909*h*. Wingsail 901 may operate similarly to wingsail 801, although wingsail 901 has multiple outlets 984*a*, 984*b*, 984*c*, 984*d*, 984*e*, 984*f*, 984*g*, 984*h* in a trailing aerofoil. Wingsail 801 may comprise a pressurized cavity 880.

The multiple outlets 984*a*, 984*b*, 984*c*, 984*d*, 984*e*, 984*f*, 984*g*, 984*h* may be provided at a particular height of wingsail 901, for example at the base of wingsail 801 or at the top of wingsail 901. In some examples, the outlets are positioned at regular intervals between the base of the wingsail 901 and the top of the wingsail 901. Wingsail 901 may also comprise one or more inlets in the front aerofoil (not shown in FIG. 28 for clarity). In some examples, the one or more inlets may be at a different height to the outlets. The multiple air outlets 909*a*, 909*b*, 909*c*, 909*d*, 909*e*, 909*f*, 909*g*, and 909*h* can act in a similar way to the single air outlet 109 of wingsail 101 in that the multiple outlets provide a high energy stream of air onto the surface of the wing to re-energise the boundary layer thus increasing the angle of attack of the wingsail 901 achievable before stall and also increasing achievable lift coefficient of wingsail 901. The multiple air outlets 909*a*, 909*b*, 909*c*, 909*d*, 909*e*, 909*f*, 909*g*, and 909*h* shall be configured so that air flow is directed to the high-pressure side and not the low-pressure side of the aerofoil by closing the low pressure side air outlets. In some examples, the air outlets on the first aerofoil element shown in FIG. 28 will be situated towards the back half of the aerofoil element towards the trailing edge. In another example, one or more of these air outlets may be situated in the front half of the leading (front) aerofoil element.

Wingsail 901 may in some examples comprise a wingsail "unit" that can be repeated to provide a modular wingsail such as wingsail 621.

Although 8 outlets are shown in the leading and trailing aerofoils of wingsail 901, it will be understood that in other examples more or fewer outlets may be used.

Figure 29A:
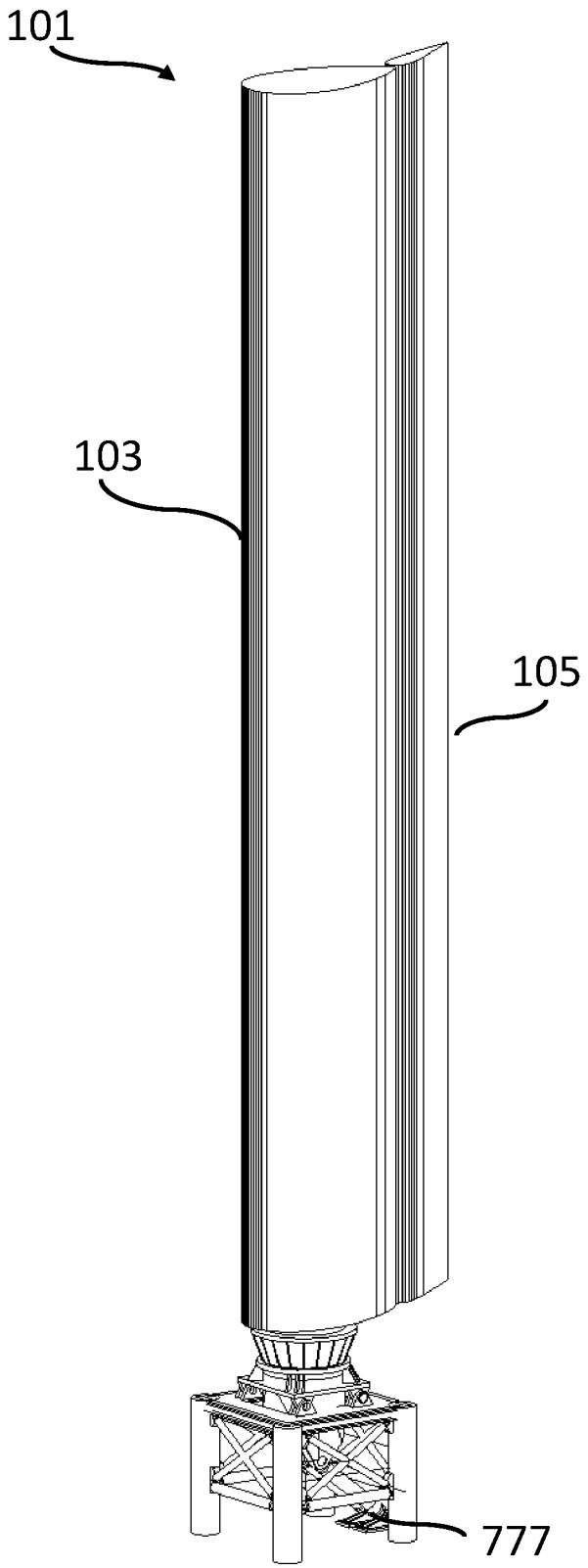
FIG. 29*a* shows a wingsail in an upright configuration.

FIG. 29*a* shows wingsail 101 in an upright configuration.

Figure 29B:
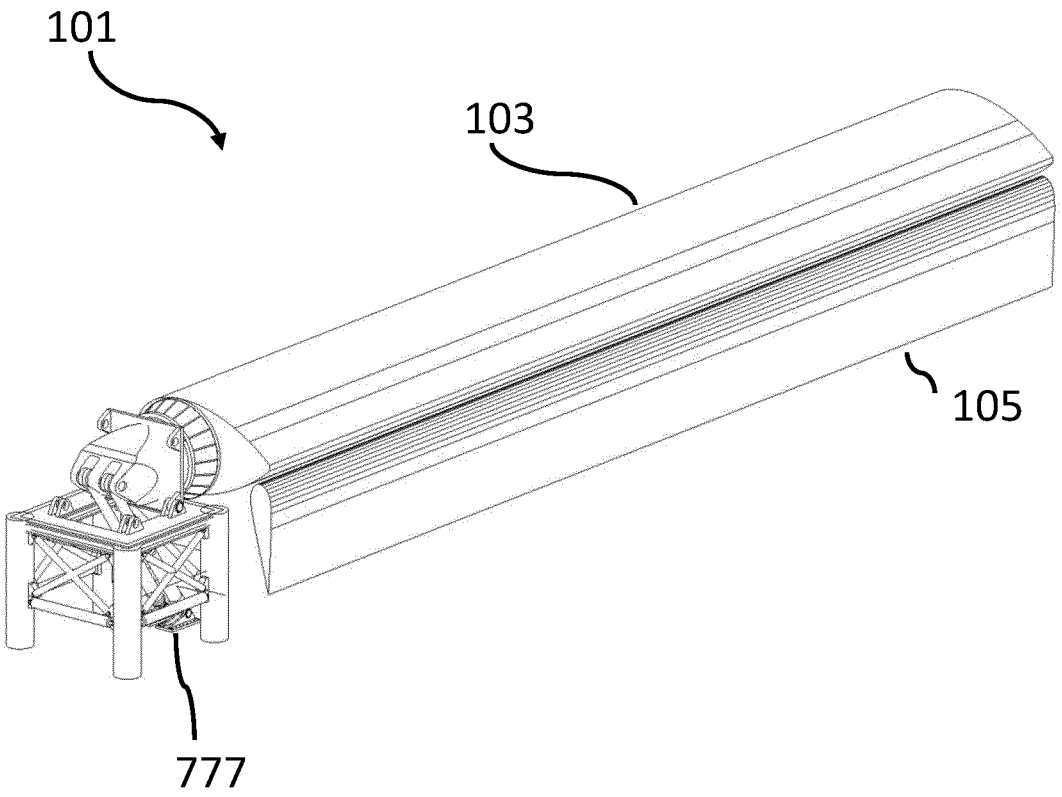
FIG. 29*b* shows a wingsail in a stowed configuration.

FIG. 29*b* shows wingsail 101 in a folded and stowed configuration wherein back (trailing) aerofoil 105 is rotated relative to the front (leading) airfoil 103 so that the chord lines of each aerofoil are substantially at 90 degrees to one another, and both aerofoils 103 and 105 are rotated from the base of the wingsail to a horizontal position to form a stowed configuration as shown in FIG. 29*b* controlled by one or two articulating rams 777 at the base of the wingsail. The stowed configuration in FIG. 29*b* is such that the in some examples wingsail 101 fits in the side channel between ships hatches and the ships side, and that the ships hatches are able to slide to an open position underneath the leading (first) aerofoil 103 or fold next to the leading (first) aerofoil 103 so that wingsail 101 does not restrict the movement of the ships hatches. In the stowed configuration shown in FIG. 29*b* the trailing (second) aerofoil 105 is rotated relative to the first aerofoil element by substantially 90 degrees, and in some examples, this allows the second aerofoil element to stay within the limits of the ships beam. The chord length of the second aerofoil element 105 is dimensioned so that it is capable of folding to this stowed configuration and rest above the side deck of the ship, and the height of the first aerofoil element 103 above the side deck of the ship is dimensioned to allow the ships hatch cover to slide underneath. Incorporating boundary layer flow control into the design of wingsail 101 allows a smaller device to be fitted to the ship whilst still producing similar thrust to a larger device, wherein this smaller device is capable of producing a stowed configuration as described above to minimise impact on port operations and loading and unloading of the vessel, wherein ships hatches need to articulate from closed to open and cargo is removed from the ships holds and may travel over the wingsail 101 in its stowed configuration shown in FIG. 29*b*. To provide a certain amount of thrust, a smaller of planform area of a wingsail using the boundary layer flow control capabilities is required than if the wingsail did not have boundary layer flow control. In other words, wingsails described herein can produce more thrust with less total planform area (total planform area can be considered to be the combined cross-sectional area of both aerofoils along the chord line of the respective aerofoil from the base to the tip of the respective aerofoil) than previous wingsails, due to the boundary layer flow control of the wingsails described herein. With the smaller planform area, in some examples, the wingsails described herein can achieve a compact stowed configuration that fits in the side channel between ships hatches and the ships side while producing required thrust for a ship.

Figure 30:
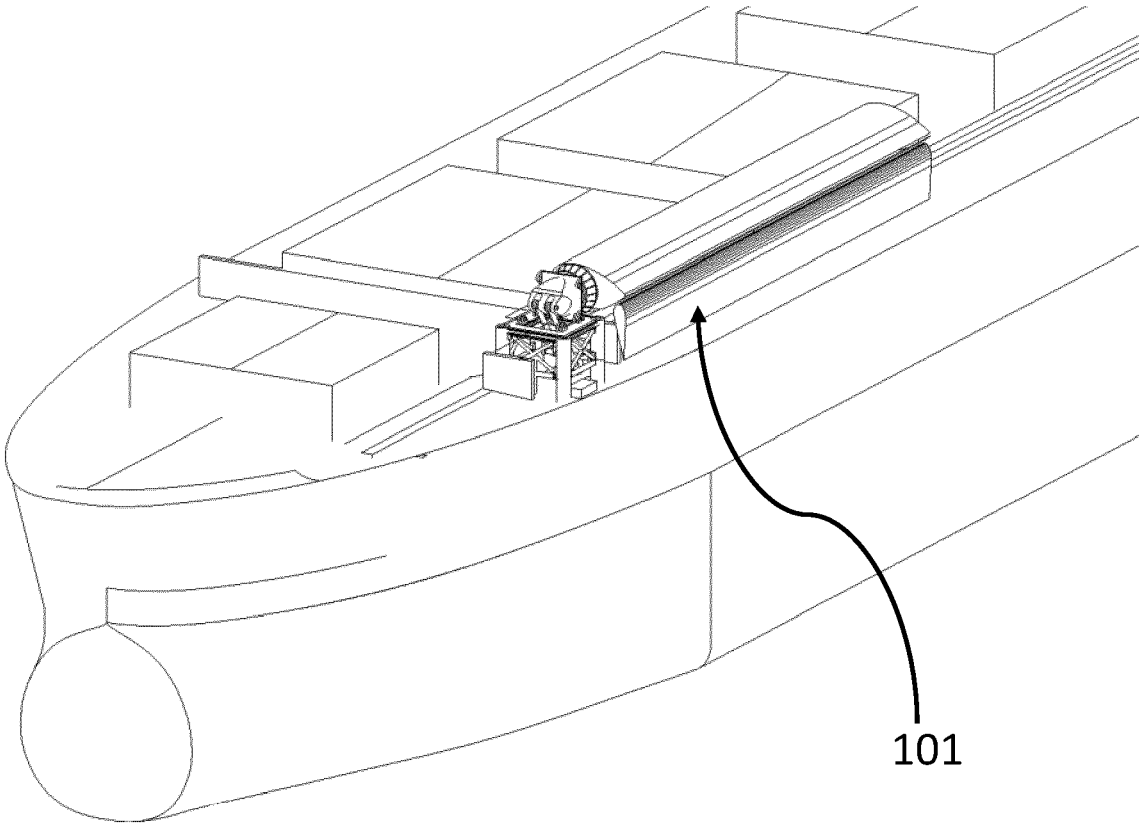
FIG. 30 shows a wingsail in a stowed configuration relative to a ship.

FIG. 30 shows wingsail 101 in a stowed configuration relative to a marine vessel (ship). As can be seen, wingsail 101 in a stowed configuration fits in the side channel between the ships hatches and the ships side allowing the ships hatches to slide underneath.

Figure 31A:
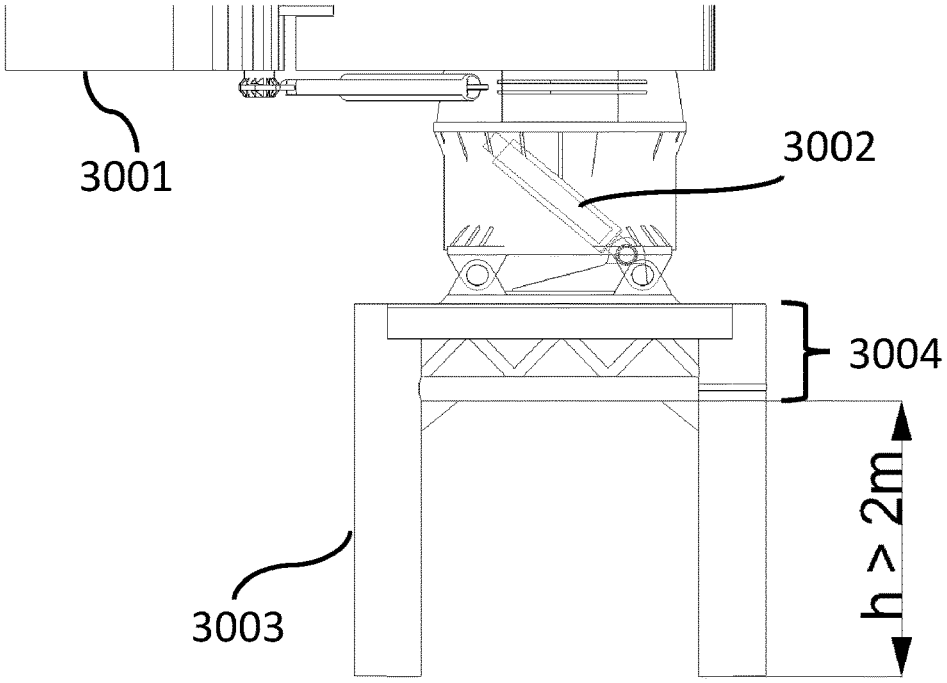
FIG. 31*a* shows a base structure of a wind propulsion device.

FIG. 31*a* shows a base structure for an energy saving device for a marine vessel. The energy saving device may comprise a wind propulsion system, (such as a wingsail as described herein, a flattener rotor, a turbosail, a kite) or for an energy generation device such as a wind turbine (having a vertical or a horizontal axis). The base is designed to be fixed to the deck of a vessel (e.g., any vessel as described herein, a bulk carrier, a tanker, a container vessel, a ro-ro vessel, a LNG carrier, a ferry, a cruise ship etc.) and comprises three or more vertical pillars 3003. Each of vertical pillars 3003 may have a cylindrical cross section, an I beam cross section, square cross section or other cross section. Each vertical pillar 3003 may be fixed to the deck of a marine vessel via flange and bolting pattern or any other method. Pillars 3003 hold a structural platform 3004 of the device to a height of at least 2 m above the deck of a to allow full working clearance underneath to allow normal operation of vessel.

Figure 31B:
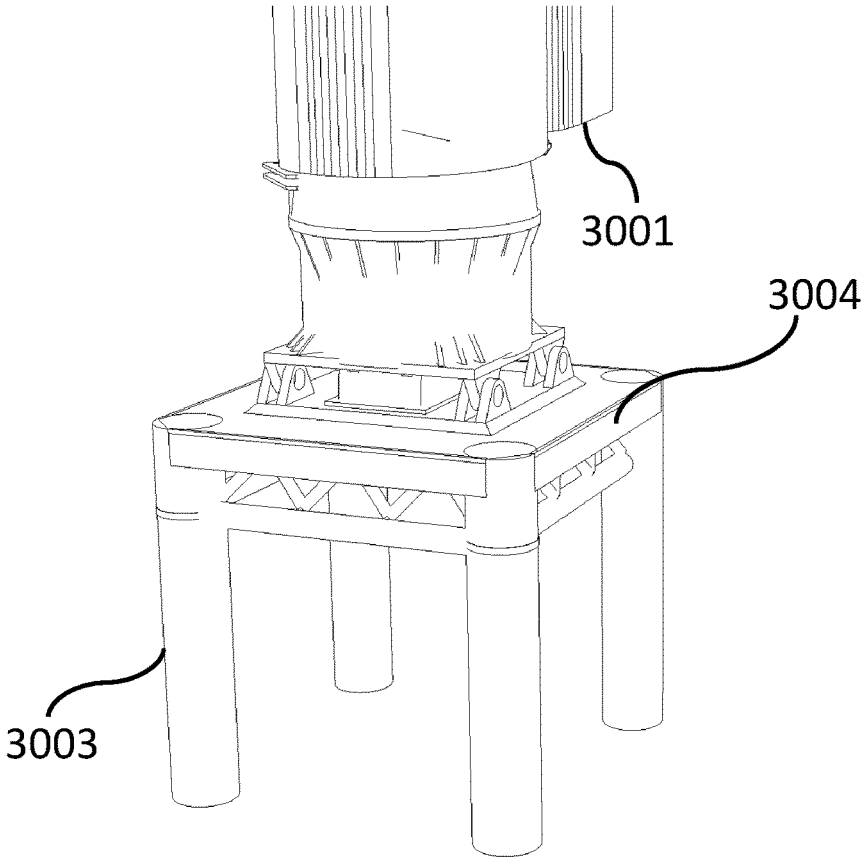
FIG. 31*b* shows a base structure of a wind propulsion device.
Figure 31C:
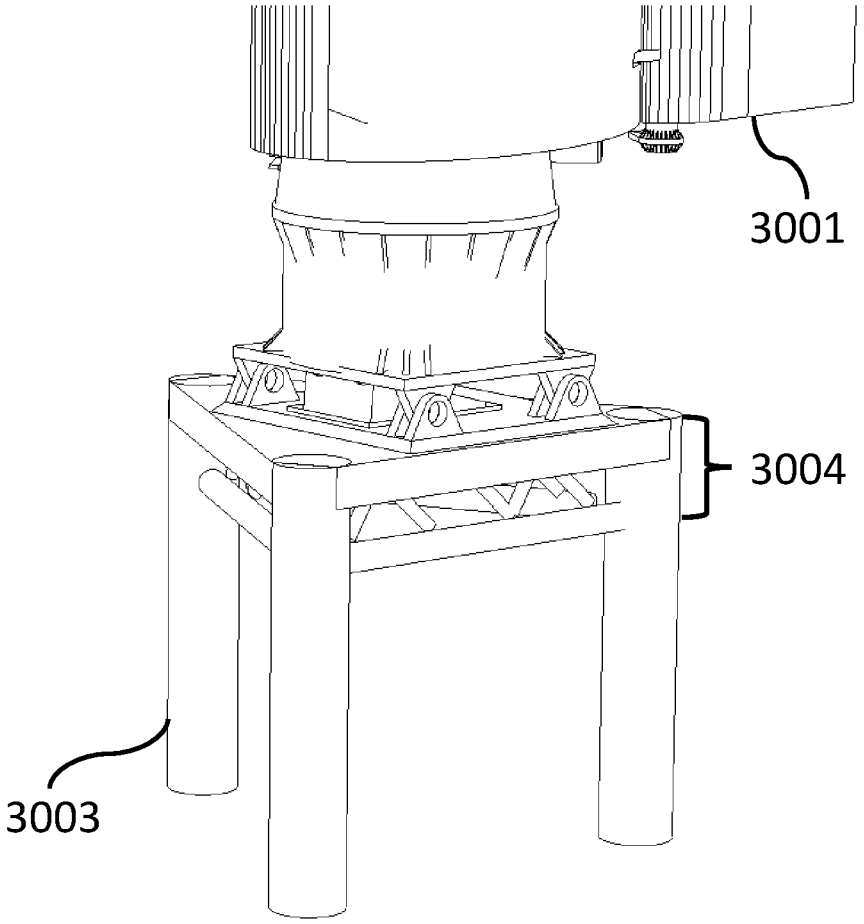
FIG. 31*c* shows a base structure of a wind propulsion device.

A linear actuator 3002 for raising and lowering wind propulsion device 3001 may be situated at the deck or may be situated on platform 3004 above the pillars 3003, as shown in FIGS. 31*a*-*c*. Linear actuator 3002 may comprise one or more raising rams, for example. By situating linear actuator on platform 3004 above the deck, the probability of accidents involving linear actuator 3004 and crew members working on the deck is reduced.

By raising wind propulsion device above deck height, wind propulsion device 3001 has less effect on deck layout (as deck space is saved). According to some examples, pillars 3003 are at least 2 m tall, to allow operations to be performed by crew under platform 3004. According to some examples, pillar 3003 are less then 4 m tall, to reduce moment arm length between the deck and platform 3004 and therefore reduce stress on the fixings of pillars 3003 to the deck of the marine vessel when wind force applies a moment to the device above the base and/or dynamic loading from the rolling or pitching moment of the marine vessel.

FIG. 31*b* shows a further view of the base structure of FIG. 31*a*. FIG. 31*c* shows an example base structure having three pillars 3003 rather than four pillars as shown in FIGS. 31*a* and 31*b*.

FIGS. 32*a* to 32*d* compare air flow differences between example wingsails having inlets and wingsails not having inlets, and also compare different inlet positioning in an example wingsail.

Figure 32A:
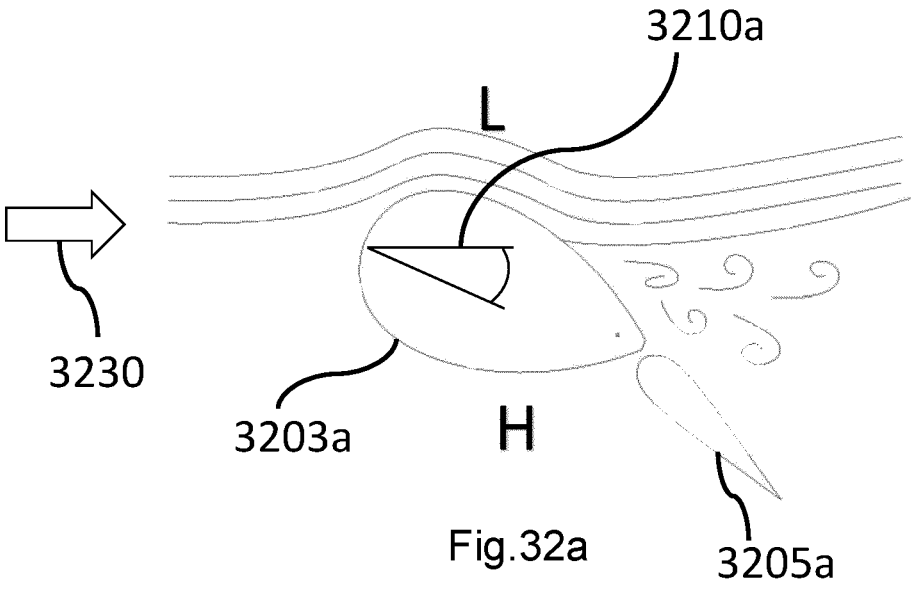
FIG. 32*a* shows airflow around a wingsail at a first angle of attack, the wingsail not incorporating aspiration.

FIG. 32*a* shows a wingsail at a 20 degree angle of attack 3210*a* to air flow 3230. In this image no aspiration (air inlet or pressurised outlet) is present. The flow stays attached until it reaches 60% of the chord length of a first aerofoil element 3203*a* of the wingsail, at which point the flow separates into a turbulent region and the wingsail is described as stalled. The flow does not reach second aerofoil element 3203*b*. This creates little lift and also causes drag.

Figure 32B:
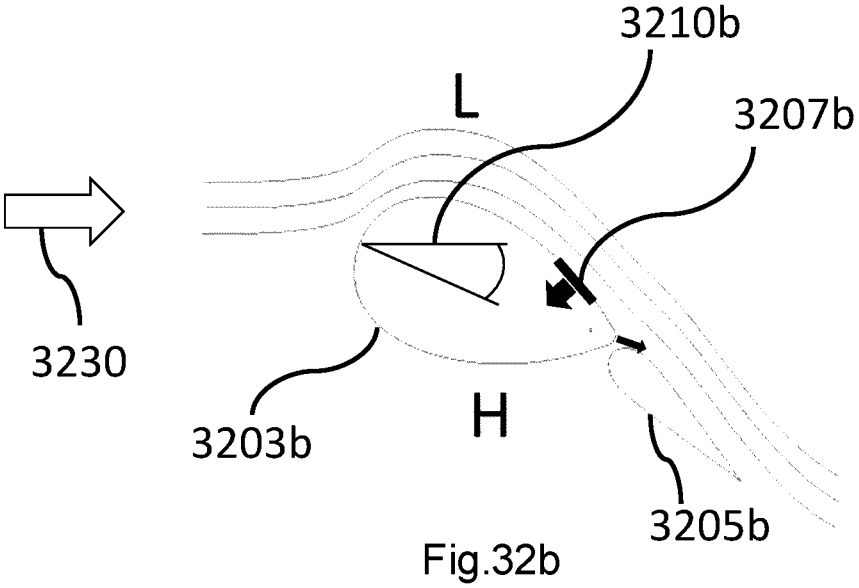
FIG. 32*b* shows airflow around a wingsail at a first angle of attack, the wingsail incorporating aspiration and having an air inlet towards the rear of a first aerofoil element.

FIG. 32*b* shows a wingsail again at a 20 degree angle of attack 3210*b* to flow 3230. The example wingsail of FIG. 32*b* incorporates aspiration by an air inlet 3207*b* towards the back quarter of the chord length of first aerofoil element 3203*b*, and a pressurised air outlet at the trailing edge of the first element. The pressurised inlet 3207*b* is located near the location of flow separation and 'sucks' in the flow at this point, removing the turbulent boundary layer and keeping the flow attached along aerofoil element 3203*b* and aerofoil element 3205*b*. This means that at an angle 3210*b* which would otherwise be stalled, the wingsail is still working well as an aerofoil and able to achieve greater lift due to the greater pressure differential between the high (H) and low (L) pressure regions due to the high angle of attack.

Figure 32C:
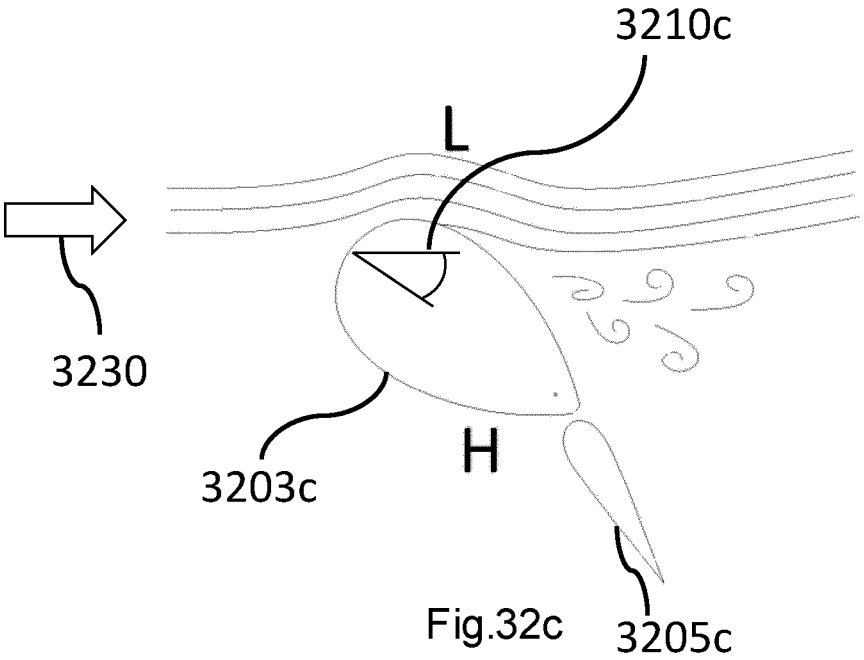
FIG. 32*c* shows airflow around a wingsail at a second angle of attack, the wingsail not incorporating aspiration.

FIG. 32*c* shows a wingsail at 30 degrees angle of attack 3210*c* to flow 3230. In this example no aspiration (air inlet or pressurised outlet) is present. The flow stays attached only until it reaches the first 30% of the chord length of the first element. In comparison on to FIG. 32*a* the separation occurs closer to the leading edge of the first element than its trailing edge due to the greater angle of attack 3210*c* of the wingsail. Again, this configuration is stalled and provides little lift and significant drag and should be avoided.

Figure 32D:
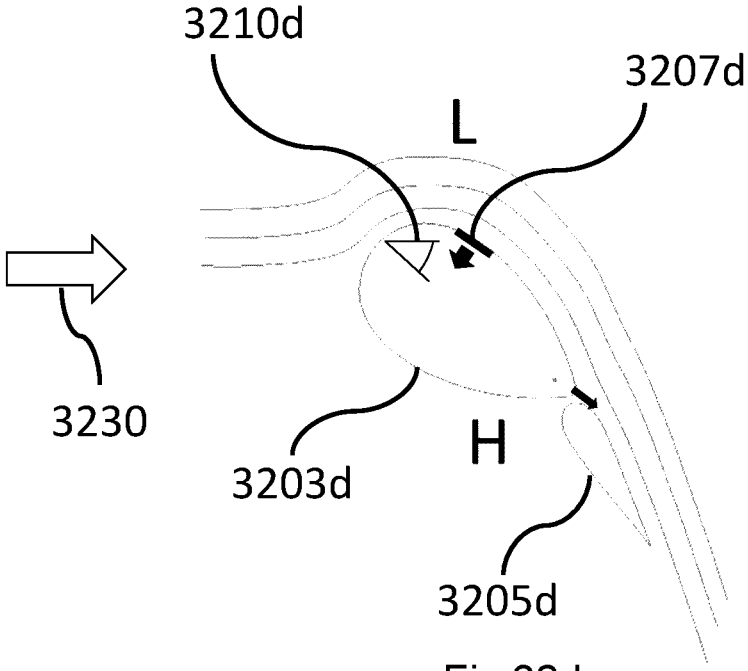
FIG. 32*d* shows airflow around a wingsail at the second angle of attack, the wingsail incorporating aspiration and having an air inlet towards the front of a first aerofoil element.

FIG. 32*d* shows a wingsail again at a 30 degree angle of attack 3210*d* to flow 3230. The wingsail of FIG. 32*d* incorporates aspiration, having an air inlet towards (within) the front quarter of the chord length of the first aerofoil element 3203*d*, and a pressurised air outlet at the trailing edge of the first aerofoil element 3203*d*. The pressurised inlet 3207 in this case is located near the location of flow separation which in this case occurs much closer to the leading edge than the trailing edge and 'sucks' in the flow at this point, removing the turbulent boundary layer and keeping the flow attached. As the air inlet 3207*d* is located much closer to the leading edge of the first element 3203*d*, this means that a greater angle of attack 3210*d* can be achieved for the whole wingsail in comparison to the wingsail of FIG. 32*a*, thus increasing the pressure differential between the high (H) and low (L) pressurised regions and creating a greater amount of thrust and reduction in fuel consumption of the vessel.

It will of course be understood that the examples described are by way of example only and are not intended to limit the scope of the invention. The term "wingsail" does not place any limitations on the size or application of the wingsail. The term "marine vessel" does not place any limitations on the size or application of the marine vessel. The marine vessel and/or wingsail may be provided at different scales.

It will of course be understood that the examples described are by way of example only and are not intended to limit the scope of the invention. It will be also understood that any of the aforementioned examples may be combined.

The Figures are schematic in nature and not necessarily drawn to scale. It will be further understood that aspects of the described examples can be combined in any way.

The invention claimed is:

1. A wingsail comprising:

a first aerofoil having a leading edge at a front of the wingsail and a trailing edge behind the leading edge; and a second aerofoil having a leading edge and a trailing edge, the leading edge of the second aerofoil being closer than the trailing edge of the second aerofoil to a point of maximum cross-sectional width of the second aerofoil;

wherein the wingsail is configured such that the leading edge of the second aerofoil can be positioned behind the trailing edge of the first aerofoil;

wherein the first aerofoil comprises:

an air inlet comprising a port air inlet positioned on a port side of the first aerofoil and a starboard air inlet positioned on a starboard side of the first aerofoil;

an air outlet;

a channel inside the first aerofoil connecting the air inlet and the air outlet; and wherein air flow from the air inlet is directed by the channel to the air outlet and the air flow from the air outlet is directed out of the air outlet towards the leading edge of the second aerofoil, wherein one or more walls are placed along the air outlet.

2. The wingsail according to claim 1, wherein the second aerofoil has a first portion comprising the leading edge of the second aerofoil, and wherein the first portion is rounded.

3. The wingsail according to claim 2, wherein the second aerofoil is symmetrical along a chord line of the second aerofoil.

4. The wingsail according to claim 1, wherein the air outlet is positioned at the trailing edge of the first aerofoil.

5. The wingsail according to claim 1, wherein, when the wingsail is being used on a starboard tack, the first aerofoil is configured so that air flow is directed through the port air inlet and is not directed through the starboard air inlet; and wherein, when the wingsail is being used on a port tack, the first aerofoil is configured so that air flow is directed through the starboard air inlet and is not directed through the port air inlet.

6. The wingsail according to claim 5, wherein the wingsail is configured to:

rotate the second aerofoil to starboard relative to the first aerofoil when the wingsail is used on a starboard tack such that the air outlet of the first aerofoil directs air flow towards the port leading edge of the second aerofoil; and rotate the second aerofoil to port relative to the first aerofoil when the wingsail is being used on a port tack such that the air outlet of the first aerofoil directs air flow towards the starboard leading edge of the second aerofoil.

7. The wingsail according to claim 6, wherein:

the wingsail is configured to draw air in the port air inlet and not draw air in the starboard air inlet when the wingsail is being used on a starboard tack; and the wingsail is configured to draw air in the starboard air inlet and not draw air in the port air inlet when the wingsail is being used on a port tack.

8. The wingsail according to claim 1, wherein the wingsail comprises:

a pressure differential generator in the first aerofoil, the pressure differential generator configured to create negative internal pressure in the first aerofoil, and wherein the negative internal pressure draws air into the main body of the device through the air inlet.

9. The wingsail according to claim 8, wherein the pressure differential generator comprises:

one or more fans driven by a motor; or a series of fans connected by one fan shaft and driven by a motor.

10. The wingsail according to claim 1, wherein the wingsail comprises:

one or more wingsail modules, wherein the wingsail modules are configured to be vertically stacked on each other, and wherein each vertical module comprises an air inlet, an air outlet, a pressure differential generator and an air vent.

11. The wingsail according to claim 1, wherein the second aerofoil rotates to a maximum rotation position relative to the first aerofoil to minimise a total span of the wingsail, and wherein the wingsail folds at a base of the wingsail to form a stowed configuration.

12. The wingsail according to claim 11, wherein:

the wingsail comprises a protective casing for covering the first aerofoil and the second aerofoil in the stowed configuration, and wherein the protective casing allows the wingsail to be raised and/or lowered and allows the wingsail to be covered when the wingsail is lowered and in the stowed configuration by performing at least one of the following: folding; rotating; rolling along a track.

13. The wingsail according to claim 1, comprising at least one of: control software for opening and closing the inlet or directing the flow from one air inlet to a next air inlet; a mechanical control system for opening and closing the inlet.

14. The wingsail according to claim 1, wherein the wingsail comprises a mechanical system which is triggered to open or close the air inlet based on the movement of the second aerofoil.

15. The wingsail according to claim 1, wherein the second aerofoil comprises at least one of: at least one air inlet, at least one air outlet.

16. The wingsail according to claim 1, wherein the first aerofoil comprises at least one of: a plurality of air inlets, and a plurality of air outlets.

17. The wingsail according to claim 1, wherein the second aerofoil comprises at least one air outlet positioned between a portion comprising the leading edge of the second aerofoil and a portion comprising the trailing edge of the second aerofoil.

18. The wingsail according to claim 1, wherein the wingsail is configured to form a stowed configuration by:

rotating the second aerofoil relative to the first aerofoil such that the chord lines of each aerofoil are perpendicular to one another; and then rotating both aerofoils from the base of the wingsail to a horizontal position to form a stowed configuration.

19. The wingsail according to claim 1, wherein the wingsail comprises a base structure, the base structure comprising:

three or more pillars supporting a platform, each of the three or more pillars having a height between two metres and four metres, and wherein the first aerofoil and second aerofoil are positioned above the platform.

20. The wingsail according to claim 19, comprising:

a linear actuator for raising and lowering the wingsail, the linear actuator being positioned above the platform.

21. The wingsail according to claim 1, wherein the air inlet is positioned between the trailing edge of the first aerofoil and a point of maximum cross-sectional width of the first aerofoil.

* * * * *